US006683524B1

(12) United States Patent
Höglund

(10) Patent No.: US 6,683,524 B1
(45) Date of Patent: Jan. 27, 2004

(54) TRANSFORMER CORE

(76) Inventor: Lennart Höglund, Blästadsgatan 126, S-589 23 Linköping (SE)

( * ) Notice: Subject to any disclaimer, the term of this patent is extended or adjusted under 35 U.S.C. 154(b) by 0 days.

(21) Appl. No.: 09/623,285

(22) PCT Filed: Sep. 2, 1999

(86) PCT No.: PCT/SE99/01518

§ 371 (c)(1),
(2), (4) Date: Sep. 2, 2000

(87) PCT Pub. No.: WO00/14753

PCT Pub. Date: Mar. 16, 2000

(30) Foreign Application Priority Data

Mar. 2, 2000 (SE) ..... 0000710

(51) Int. Cl.[7] ..... H01F 27/24
(52) U.S. Cl. ..... 336/213; 336/212; 336/215
(58) Field of Search ..... 336/212, 213, 336/214, 215

(56) References Cited

U.S. PATENT DOCUMENTS

| | | | | |
|---|---|---|---|---|
| 523,572 A | | 7/1894 | Hassler | |
| 2,305,999 A | | 12/1942 | Steinmayer et al. | |
| 2,333,464 A | | 11/1943 | Christensen | |
| 2,400,184 A | | 5/1946 | Woolfolk | |
| 2,401,952 A | | 6/1946 | Mayberry | |
| 2,414,603 A | | 1/1947 | Nelson | |
| 2,458,112 A | | 1/1949 | Steinmayer | |
| 2,498,747 A | | 2/1950 | Weigand | |
| 2,544,871 A | | 3/1951 | Weigand | |
| 2,561,250 A | | 7/1951 | Treanor | |
| 4,325,045 A | | 4/1982 | Mehl | |
| 4,497,449 A | | 2/1985 | Lin et al. | |
| 4,504,813 A | * | 3/1985 | Strang | 336/216 |
| 4,557,039 A | | 12/1985 | Manderson | |
| 4,592,133 A | * | 6/1986 | Grimes et al. | 29/605 |
| 4,761,630 A | * | 8/1988 | Grimes et al. | 336/213 |
| 4,893,400 A | * | 1/1990 | Chenoweth | 29/606 |
| 5,608,371 A | * | 3/1997 | Valencic et al. | 336/210 |
| 5,791,585 A | | 8/1998 | Knight et al. | |

FOREIGN PATENT DOCUMENTS

| | | |
|---|---|---|
| GB | 957677 | 5/1964 |
| IT | 351420 | 8/1937 |
| SE | 163797 | 7/1958 |

* cited by examiner

*Primary Examiner*—Ahn Mai
(74) *Attorney, Agent, or Firm*—D. Peter Hochberg; Katherine R. Vieyra; Sean Mellino

(57) ABSTRACT

A transformer core comprises at least one leg and at least one yoke part, wherein the cross section of the leg or the legs regularly multi-edged with more than four edges. The core is made up of rings rolled from strips of constant width, whereby good electrical properties are achieved. The transformer is also easy to manufacture and avoids waste of material.

28 Claims, 27 Drawing Sheets

TRANSFORMER CORE

BACKGROUND OF THE INVENTION

1. Field of the Invention

The present invention relates to transformer cores and especially to three-phase cores comprising three frames of rings of transformer plate defining yokes in, for example, horizontal triangles and vertical legs extending between corners of the yokes. The invention also relates to single-phase shell cores having many rings, frame cores having two frames and two yokes, inductors, and components for the foregoing and transformers.

2. Description of the Prior Art

Transformer cores are almost solely made of transformer plates laid edge to edge to an EI form or ring. Some of them are made of cut rings and called C-cores. Others are wound to two rings inside a larger ring and cut to two E-core parts used for three-phase transformers.

Toroid transformers have a ring core which is not cut and is the only practical exception to the EI form. Small shell single-phase transformers and large three-phase transformers use the EI form of core.

A common three-phase transformer core will now be described. Virtually all have six coils, which by means of wires are wound on a cylinder forming three rod-shaped windings. The cores are composed of a multitude of thin, rectangular plates of electromagnetic material, which are stacked side-by-side with their long sides in alignment to form each of the legs.

The E-shaped plates form one yoke, and three short legs each extending its body into one of the transformer coils. Each leg faces a leg from a yoke at the opposite end of the coil. Thus, there is a core leg extending through each of the three sets of wound coils encircling the legs. The coils are bridged by one yoke at each side of the coils.

The plates of the core are thin sheets of metal, assembled in place, one sheet at a time, until an entire core is put together. This is a slow, labor intensive process.

The EI cores are inefficient to operate, and electrical losses occur at the juncture of many mating edges between the plates. That is, EI stacked cores in general have the drawback that the magnetic field has to cross small gaps between the edges from plate to plate.

There are further losses in the four outer corners of a complete three-phase transformer where field radiation occurs, since there is no ready path for the magnetic fields to flow. Further, the yokes are made of core material that is not encircled by coils and therefore does not contribute to the efficiency of the transformer, but to the contrary the consequence is that material and labor to form the yokes can be regarded to be wasted.

When the operation of a standard three-phase transformer is commenced, there are very high current losses. There are thus high losses during start-up as well as under load for standard three-phase transformers due to the conventional three-phase transformer cores.

The EI cores used in three-phase transformers have numerous other shortcomings. They vibrate and hum during operation. They set up electromagnetic radiation that is easily detectable at about five feet from typical three phase transformers. Due to e.g. electromagnetic forces in the space between the edges of the plates, there [is] will be noise in the core. Conventional three-phase transformers generate excessive amounts of heat, and means must be employed to cool them, requiring an excessive amount of cooling fluid.

As noted above, the inefficiencies of three-phase transformers requires each of them to have a large size. This requires them to be larger in both width and height. Large transformers are difficult and expensive to transport, due both to their size and height. In addition, shipping large transformers sometimes results in damage due to their instability. For example, large transformers have at times been unable to be shipped to offshore installations, and such shipping if possible is expensive. Designers of transformer cores have striven to obtain legs with an essentially circular cross-section because that gives the best efficiency of the final transformer. That is, transformer windings are nearly always cylindrical, having an interior void within the windings with a circular cross section. The core designer wants to fill that void. This is true for both three-phase and single-phase transformers. However, there is always a trade-off between efficiency and production requirements, leading to non-optimal transformer cores with non-circular legs.

U.S. Pat. No. 4,557,039 (Manderson) discloses a method of manufacturing transformer cores using electrical steel strips having approximately a linear taper. By selecting a suitable taper, a hexagonal or higher order approximation of a circular cross section for the legs of the cores is produced. However, the tapered strips are extremely difficult and time-consuming to produce, and the design is particularly not well adapted to large-scale commercial production.

In FIGS. 1, 1*a–b* is shown a prior art three-phase transformer core according to Manderson, generally designated 10. The core has a general delta-shape, as is seen in the isometric view of FIG. 1, with three legs interconnected by yoke parts. In FIG. 1*a*, a cross-sectional view of the core is shown before final assembly. The core comprises three identical ring-shaped parts 12, 13 and 14, the general shape of which appears in FIG. 1 Each ring-shaped part fills up one half of two legs with hexagonal cross-sections, see FIG. 1*a*, thus totaling the three legs of a three-phase transformer. The ring-shaped parts are initially wound from constant width strips to three identical rings 12*a*, 13*a*, 14*a* with rhombic cross-sections comprising two angles of 60° and two angles of 120°. These rings 12*a*–14*a* constitute the basic rings. The orientation of the strips also appears from FIGS. 1*a* and 1*b*.

Outside of the basic ring in each ring-shaped part there is an outer ring 12*b*, 13*b*, 14*b* of a regular triangular cross-section. The outer rings are wound from strips with constantly decreasing width. When the three ring-shaped parts 12–14 are put together, see FIG. 1*b*, they form three hexagonal legs on which the transformer windings are wound.

A drawback with this solution is that every size of transformer requires its own cutting of the strips. Also, the outer rings 12*b*–14*b* are made of strips with decreasing width, leading to waste and also making the transformer according to Manderson very difficult to manufacture. Another drawback is that the design is not self-supporting, i.e. the ring-shaped parts tend to move in respect of each other.

U.S. Pat. No. 2,544,871 (Wiegand) discloses a transformer core with three legs, each leg being made from two ring-shaped parts and an auxiliary ring shaped part. There are thus nine ring shaped parts, three of which are used in an inefficient way, making Wiegand an expensive and impractical device.

Transformer cores are also described in the following documents: Swedish Patent No. 163797, U.S. Pat. No. 2,458,112, U.S. Pat. No. 2,498,747 and U.S. Pat. No. 2,400,184. However, the above mentioned problems are not overcome by the cores described in these documents.

The difficulty and expense of making transformer cores having a ring with a decreasing width has rendered this proposed transformer core construction totally impractical, and no such cores are known to exist in commercial use. Despite the recognition that transformer cores should nearly fill the circular interior of transformer windings, none has hitherto been proposed which is practical and economical. The design of such a transformer core would be of tremendous importance with respect to both three-phase and single-phase transformers. In addition, the provision of similarly designed inductors would be a most significant contribution to the art.

The electromagnetic and mechanical shortcomings of present three and a single-phase transformer core is very significant considering the number of transformers sold and in use throughout the world. The following figures demonstrate this. They were taken from the "The World Market for Transformers 2000" published by Golden Reports, of 109 Uxbridge Road, Ealing, London W5 5TL, United Kingdom. In 1999, the market in the United States for transformers was 2,664 units. The total for the rest of the world was about 4,828 transformers. The world market for transformers from 1994 through 1999, was as follows:

| | |
|---|---|
| 1994 | $9,287,920,000 |
| 1995 | $10,107,530,000 |
| 1996 | $10,491,770,000 |
| 1997 | $10,782,230,000 |
| 1998 | $11,163,650,000 |
| 1999 | $11,339,030,000 |

The World Market for transformers is growing, as shown in the following table:

| | |
|---|---|
| 1994 to 1995 | 8.8% |
| 1995 to 1996 | 3.8% |
| 1996 to 1997 | 2.8% |
| 1997 to 1998 | 3.5% |
| 1998 to 1999 | 1.6% |

with an average annual growth of 4.1%. The sales of transformers is extremely large, as the following demonstrates:

| | |
|---|---|
| 1997 | $10,782,000,000 |
| 1998 | $11,164,000,000 |

SUMMARY OF THE INVENTION

An object is to provide a transformer core, which is easy to manufacture and avoids material waste.

Another object of the present invention is to provide a transformer core wherein the energy losses are significantly reduced.

Another object of the invention is to provide a transformer core for a transformer winding which is electromagnetically efficient.

It is yet another object of the invention to provide a transformer core for a transformer winding which substantially fills the void in the winding.

A still further object is to provide a transformer core for substantially filling a transformer winding comprising an assembly of wound metal strips, each of the metal strips having constant widths.

It is an additional object to provide a ring shaped core for transformers made of a combination of rings of wound strips of ferromagnetic material, each component ring having an equal width.

It is still a further object of the invention to provide ring shaped transformer cores for three-phase transformers made of set of wound metal strips, the metal strip of each component of the set having an equal width.

Another object is to provide a ring-shaped transformer core having straight legs and yokes curved at their intersection with straight legs for rendering the flow of magnetic fields efficient, the legs having polygonal cross sections and being made of wound metal strips, each strip having a constant width.

It is yet another object of the invention to produce a three-phase transformer core with rings made from transformer plate of a constant width for the respective rings and with a controlled thickness, the core having legs whose cross-section is composed of rhombs and/or rhomboids, including squares and rectangles, forming a polygon.

Another object is to provide a three-phase transformer core made of rings of offset transformer plate, the core having legs composed in cross-section of rhombs and/or rhomboids, forming a regular polygon having at least six sides.

It is an object of the invention to provide the foregoing transformer cores that can be produced in commercial volumes having high quality as transformer cores and being produced in a practicable manner.

Another object is to provide a transformer core that does not suffer from the relatively high electromagnetic losses at junctures of adjoining sheet metal plates, end corners and angled corners of EI cores presently used in three-phase transformer cores.

Still yet another object is to reduce the noise from electromagnetic forces between the plates.

A further object is to provide a transformer core that does not hum or vibrate, as do transformer cores in current use.

Another object is providing a transformer core that does not suffer start up losses, as do conventional transformer cores.

A further object is to provided a practical and efficient transformer core for three-phase transformers which enables the windings to be arranged in a compact orientation, i.e. at the corners of an imaginary triangle.

It is yet still another object of the invention to provide a three-phase transformer core made from rings of offset transformer plate, the rings cooperating to define legs in a delta arrangement for extending through transformer windings in a delta arrangement.

It is an additional object of the invention to provide a three-phase transformer core which is more effective and efficient than prior transformer cores for three-phase transformers, yet does not require the manual labor to assemble the core as do conventional EI cores.

Still another object is to provide an improved single-phase transformer core having as a cross-section a polygon of at least six sides.

An additional object is to provide a single-phase transformer core having in cross-sections rhombs and/or rhomboids, defining a polygon having at least six sides.

Yet another object is to provide an improved inductor core having a polygonal cross section with wound rings, each ring being made of a metal strip with equal width.

A further object of the invention is to provide an improved inductor core having yokes of polygonal cross section made of offset laminates of transformer plate, each of equal width, and made from metal of constant width.

It is a general object to make inductors of excellent electromechanical efficiency that can be made economically using metal strips of constant non-varying widths.

It is another object of the present invention to provide an improved frame (as explained below) for transformer cores.

An additional object is to provide an improved frame for inductor cores.

A further object is to provide an improved transformer.

A still further object of the present invention is the provision of an improved inductor.

Another object is to provide a method of manufacturing a transformer that is well adapted for large-scale production.

Other objects will occur to those skilled in the art from the description to follow and from the appended claims.

The invention is based on the realization that a transformer core with one or more regularly multi-edged legs with more than four edges can be assembled from rings of strips with constant width.

An important aspect of the present invention with respect to three-phase transformer cores is to make or fill rhombic cross-sections in three legs in a triangular pattern using three frames, each frame being composed of at least two rings of wound offset transformer plate, where each frame forms part of two legs. Each leg has a polygonal cross-section made of rhombs and in some cases, rhomboids. The straight or leg portion of two frames cooperate to form a transformer core leg, the leg having the polygonal cross-section. The leg portion of the cooperating parts of two frames each define one half of the desired polygonal cross-section, and together they form the desired full polygonal cross-section. While the simplified polygonal cross-section is a hexagon, any number of even sides, six or above, can be prepared pursuant to the invention. Moreover, while the combined leg portions can cooperate to form the desired polygonal cross-section, with each of the two frames forming one half of the desired polygonal cross-section, it is also possible pursuant the invention to form the desired rhombic cross-section using frames to each contribute one third of one desired rhombic cross-section.

Another important aspect of some of the preferred forms of the invention is that the transformer core is made of frames of rings of offset or splayed material as defined below, each ring being made of wound sheets of transformer plate of a constant width. Each frame has surfaces which match corresponding surfaces of another frame, and they connect and lock the frames together. This differs from the prior art as shown in FIG. 1 where the surfaces are flat or even, because such surfaces can slip apart and make it difficult to keep the frames in a tight fixed position during subsequent manufacturing stages and also makes such transformer cores less stable and shock resistant during transport and installation. The traditional E-shaped core of stacked thin sheets is very vulnerable and is likely to loose some of its initial efficiency when moved around in the factory and during transport and installation. The edges of the prior art plates separate somewhat when a core or transformer is moved around, as is well known in the art—and the preferred embodiments do not suffer this disadvantage.

This differs from U.S. Pat. No. 2,544,871 to Wiegand where three cores and three auxiliary cores cooperate to form three transformer legs, since it takes two rings and an auxiliary ring to form one transformers leg. The three auxiliary cores are not necessary in the present invention.

BRIEF DESCRIPTION OF DRAWINGS

The invention is now described, by way of example, with reference to the accompanying drawings, in which:

FIG. 2 is an isometric view of a three-phase transformer core according to one embodiment of the invention with legs having hexagonal cross-sections, showing the cross-section of each of the legs;

FIGS. 2*a*, 2*b* and 2*c* are transverse cross-sections of each of the legs of the core shown in FIG. 12.

FIG. 11 shows in isometric form a three-phase transformer core with legs in a generally flattened or planar arrangement;

DETAILED DESCRIPTION OF THE PREFERRED EMBODIMENTS

Preferred embodiments of a three-phase transformer core according to the invention will now be described.

Figure 1:
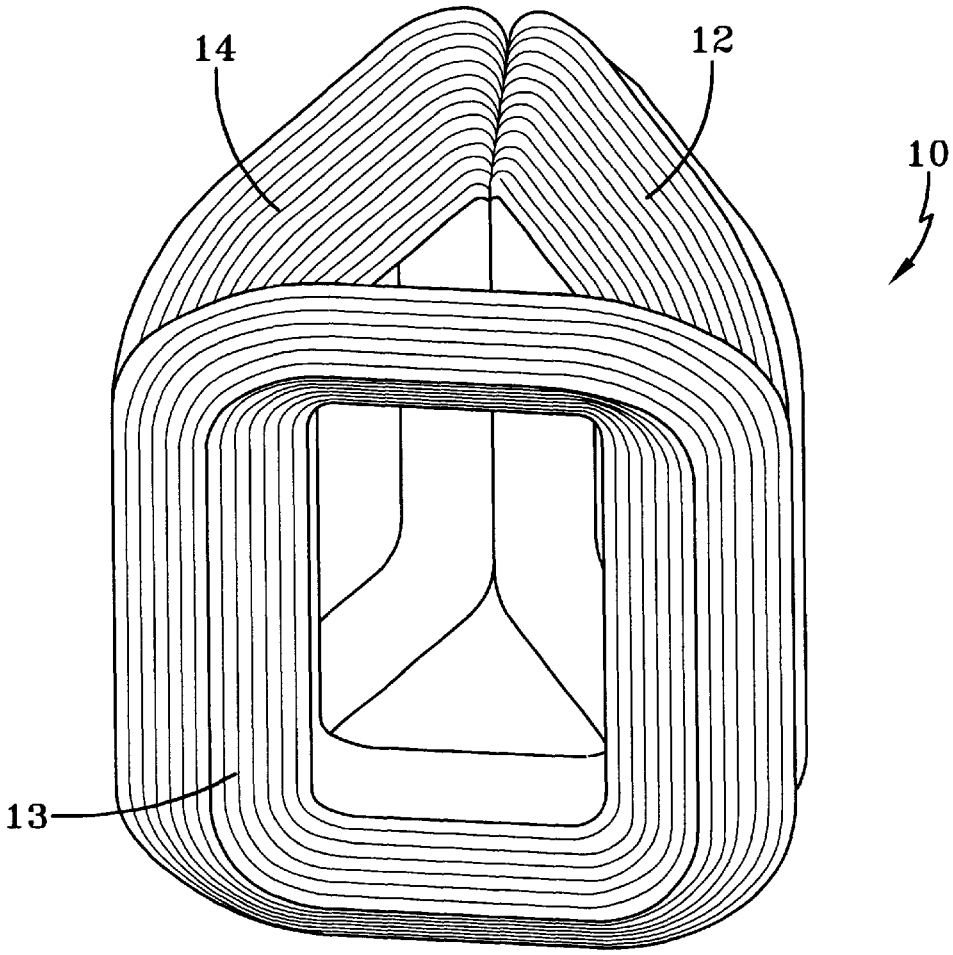
FIG. 1 is an isometric view of a prior art three-phase transformer core made of rings with rhombic and triangular cross-sections.
Figure 1A:
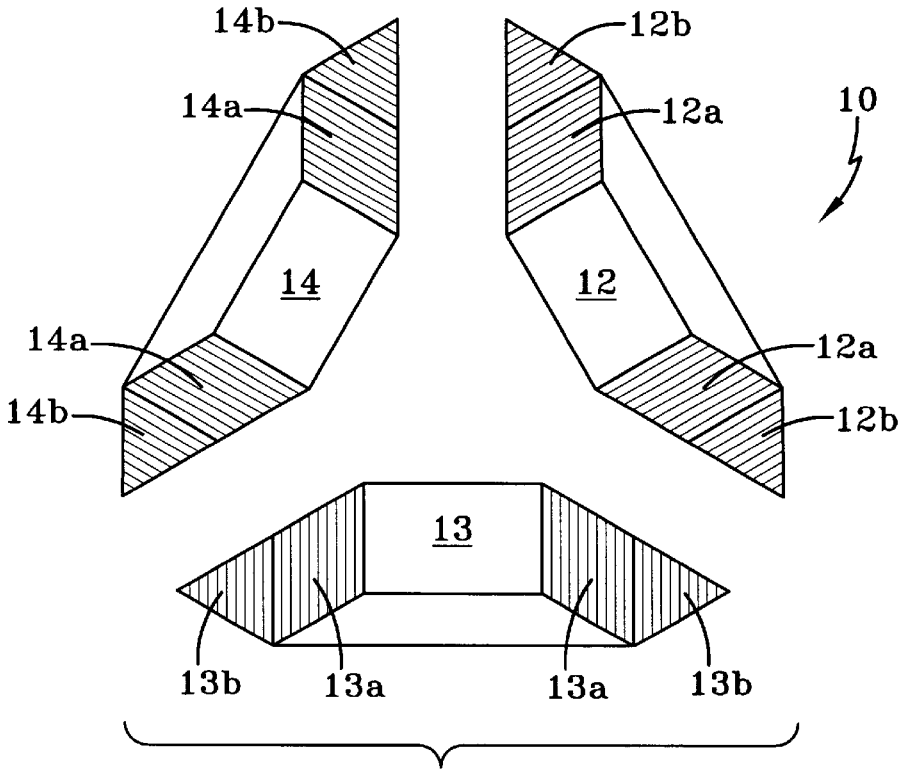
FIGS. 1*a* and 1*b* are transverse cross-sections of any of the legs of the core shown in FIG. 1 before and after assembly, respectively.
Figure 1B:
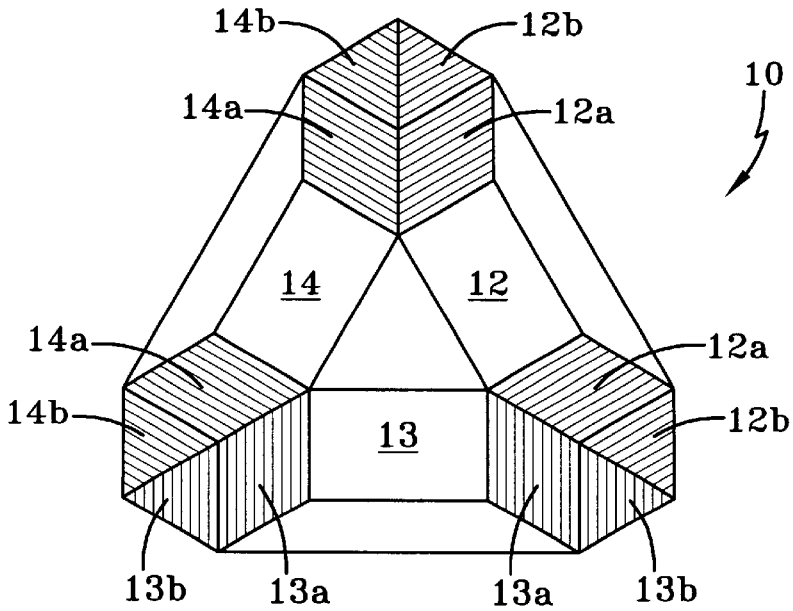

FIGS. 1, 1*a* and 1*b* has already been discussed in connection with prior art and will not be explained further.

In FIG. 2 is shown a three-phase transformer core according to the invention, generally designated by the numeral 20. In its general shape it is similar to the prior art transformer core shown in FIGS. 1, 1*a*, 1*b* with a general delta-shape but is designed in an entirely different way. The core is made up of three frames 22, 23, 24, each comprising several rings. (The word "ring" means a strip of material which is wound as a cylinder of many layers of the strip (to give the ring its thickness) and then slid over, offset or splayed as explained below. Rings are primarily circular but can have any shape with generally rhombic or rhomboidal cross sections, which include in some special cases quadratic and rectangular cross-sections. The term "frame" as used herein, means a ring-shaped part composed of two or more rings of laminated transformer plate, that is preferably wound strips of sheet metal. The frame is composed of rings of strips of transformer plate with a cross-section, which is a combination of the rhombic cross-sections of the rings. The frame, as well as the rings of which the frames are composed, is preferably generally rectangular. As used herein, the terms "offset", "profiled" or "splayed" means the layers or laminates of transformer plate sheet metal are shifted so that edge of each layer is laterally displaced from the adjacent layer, the displacement being in the same direction for any ring. Since the rings preferably wound strips of sheet metal, the layers are slid over and are almost coaxial. Thus, an offset, profiled or splayed ring is a truncated core. Since the metal is of small dimension, the surface looks and feels smooth. The term "rhomb angle" means the bottom angle in a rhomb when the innermost edge of a leg is directed downwards. Although the figures herein show the layers schematically, they are in fact thinner than shown. The terms "delta" or "triangular" shaped means that three legs are extendable through parallel cylinders, such as are defined by windings of conductive wire, at three corners of an imaginary triangle or "delta." (Three non-aligned parallel legs are in a delta arrangement.) Each frame 22–24 has a pair of opposed, parallel yokes. A set of three legs 25–27 extends between the respective yokes. Straight portions of two of the frames are arranged to form to legs 25–27. That is, one straight portion of frame 22 cooperates with a straight portion of frame 24 to form leg 25, straight portions of frames 22 and 23 form leg 26, and straight portions of frames 23 and 24 form leg 27. The yokes have at their respective ends rounded corners. The legs should fill the interior of the transformer windings through which they extend. The frames 22, 23 and 24 are each composed of different rings. The rings of each frame come in two widths, broad or narrow wherein the narrow rings are made up of strips of half the width of the broad rings. The term "width" is the transverse dimension between the longitudinal edges; the width of the broad strips is, shown as "w", and that of the narrow strips is shown as "w/2" in some of the figures. Also, they come in two thicknesses, thin or thick wherein the thin or low rings have half the thickness or height of the thick rings. (The thickness refers to the number of layers of sheet metal, each layer having a constant thickness.) From the shape of a hexagon, $$t=w\cdot\sin 60=w\cdot\sqrt{2}/2=w\cdot 0.866.$$

Unless otherwise stated, these definitions will be used throughout this description. The strips are preferably made of transformer plate, the plate being sheet metal.

Figure 2A:
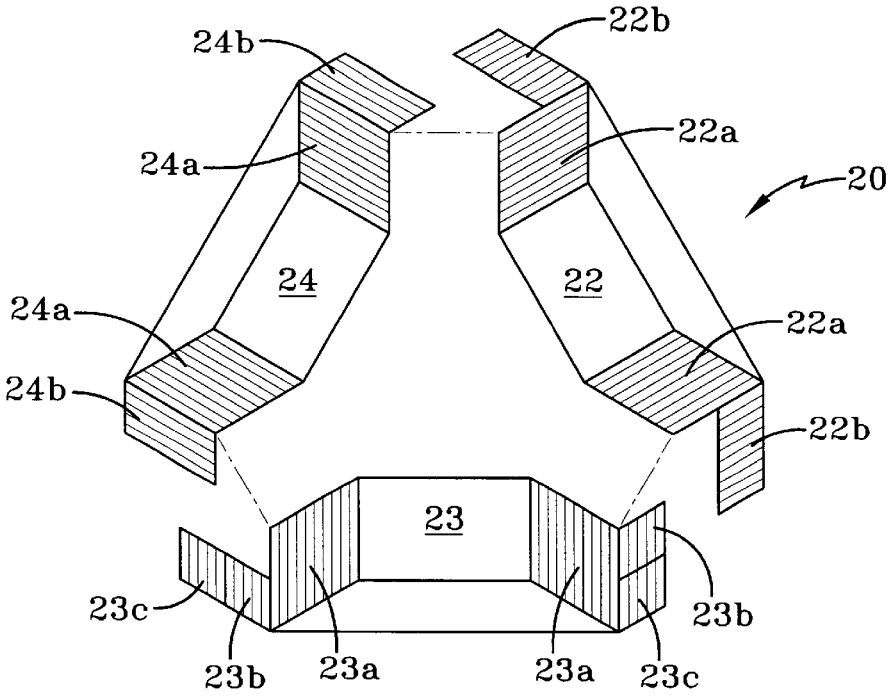
Figure 2B:
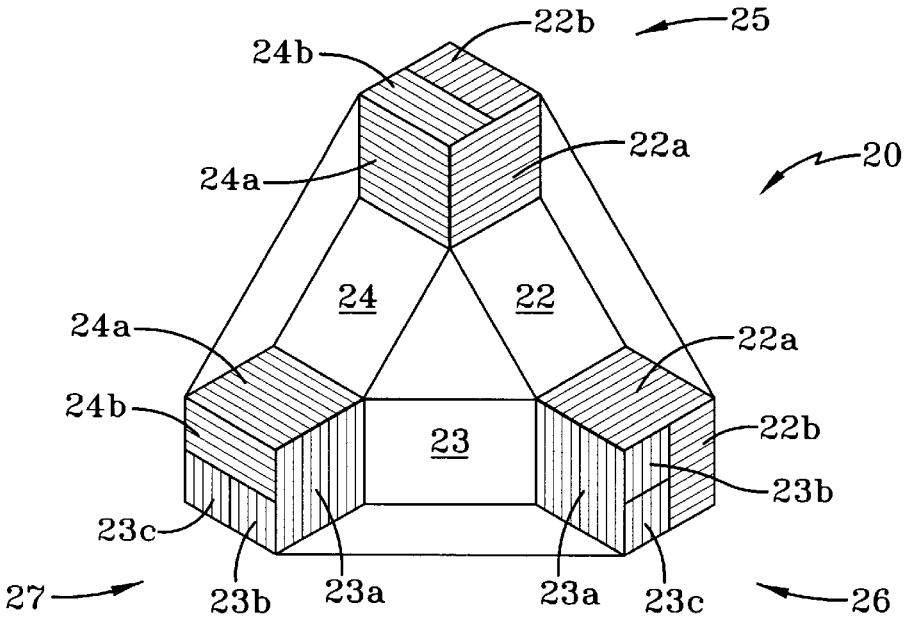

Frame 22 comprises a broad, thick ring 22*a* having a width w and a thickness t, and a narrow thick (or high) ring 22*b* having a width w/2 and a thickness t, equal to that of the broad, thick basic ring 22*a*. The cross-section of leg 25 is shown in FIG. 2*a*, and the cut away portions of rings 22*a* and 22*b* are shown. Frame 23 is composed of a broad thick ring 23*a*, identical to ring 22*a*, a narrow thin (or low) ring 23*b* and another narrow thin ring 23*c*. Narrow thin rings 23*b* and 23*c* have a width w/2 and a thickness t/2, one half the width and one half the thickness of rings 22*a* and 23*a*. The cross-section of leg 26 is shown in FIG. 2*b*. Frame 24 is composed of a broad thick ring 24*a* and a broad thin ring 24*b*. Ring 24*b* has the same width w as rings 22*a*, 23*a* and 24*a*, and the same thickness t/2 as ring 23*b* and 23*c*. The cross-section of leg 27 can be seen in FIG. 2*c*.

The cross sections of legs 25, 26 and 27 each form a regular hexagon. The hexagons substantially fill the cylinders defined by transformer windings. The hexagons can be described in terms of the rhombs and rhomboids therein.

Each of the frames 22–24 comprise a broad, thick basic ring 22*a*–24*a*, respectively, similar to those described with reference to FIG. 1.

Still referring to FIG. 2 and FIGS. 2*a*, 2*b* and 2*c*, rings 22*a*–24*b* form in pairs, four of the sides in the hexagonal legs. The remaining rhombs in the legs are built in different ways.

Still referring to FIGS. 2, 2*a*, 2*b* and 2*c*, rings 22*a*–24*b* form, in pairs, four of the sides in the hexagonal legs. The remaining rhombs in the legs are built in different ways.

In the first leg 25, the additional rhombic cross-section is composed of two rhomboids. The first one, designated 24*b* and part of frame 24, is a broad thin ring. The second one, designated 22*b* and part of ring 22, is a narrow thick ring.

In the second leg 26 to the right in FIG. 2, the additional rhombic cross-section is composed of one rhomboid and two rhombs. The rhomboid is filled by narrow thick ring 22*b* belonging to the frame 22. Two narrow thin rings 23*b*, 23*c* belonging to frame 23, fill the rhombs.

In third leg 27 to the left in FIG. 2, the additional rhombic cross-section is also composed of one rhomboid and two rhombs. The broad thin ring 24*b* belonging to the frame 24 fills the rhomboid. Two narrow thin rings 23*b*, 23*c* belonging to the frame 23, fill the rhombs. The reason that frame 23 comprises two thin narrow rings instead of one narrow thick ring is that this larger ring can not be both narrow and thick, as required in the left leg 27, and broad and thin, as required in the right leg 26. Thus, instead two narrow thin rings are used.

All upper or lower yokes connecting the legs 25–27 have different shapes but all are built from one basic ring with a large rhombic cross-section plus one ring with a rhomboidal cross-section or two rings with a small rhombic cross-sections. This gives all yokes the same total cross-sectional area.

A second preferred embodiment is described with reference FIGS. 3 and 3*a*–3*q*. This embodiment is for a three-phase transformer core having three frames 32–34 arranged in a triangular or delta pattern. (It should be noted that in a three-phase transformer core with hexagonal legs and yokes in a triangle, the innermost parts of the cross sections of the rings must be 60°. This is the definition of the orientation of the angle notations in this application.) As explained below, the core has three legs, each of which extends through a transformer coil. The frames are composed of rings, each ring being a wound sheet of transformer plate sheet metal, the layers of each of which are offset, i.e. splayed or profiled. In cross-section, the legs form regular hexagons. The terms referred to earlier (broad, narrow, thick, thin, etc.) have the same meaning as they did earlier.

Figure 3:
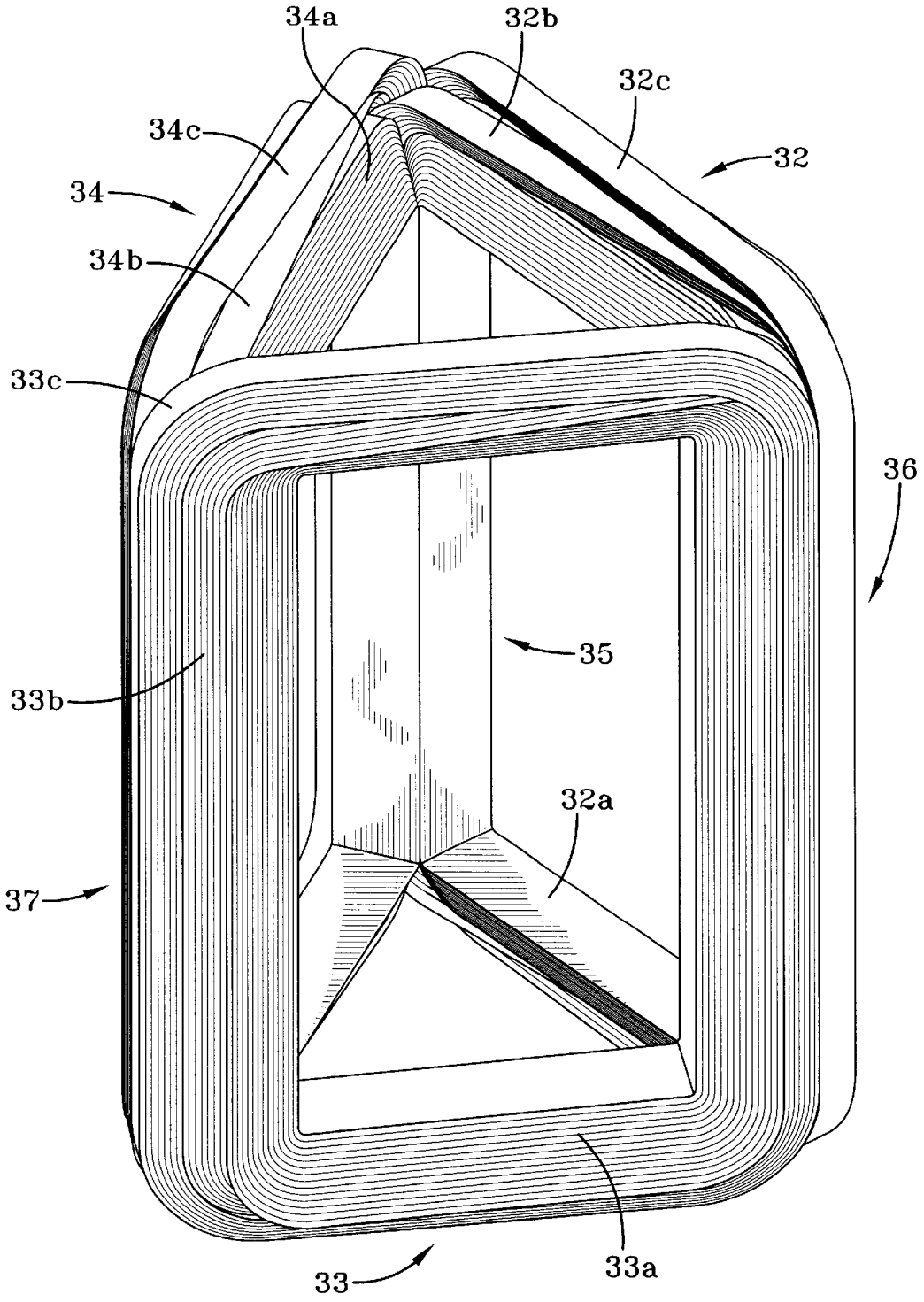
FIG. 3 is an isometric view of another preferred embodiment of the invention, the cross-section of the legs thereof being regular hexagons.
Figure 3A:
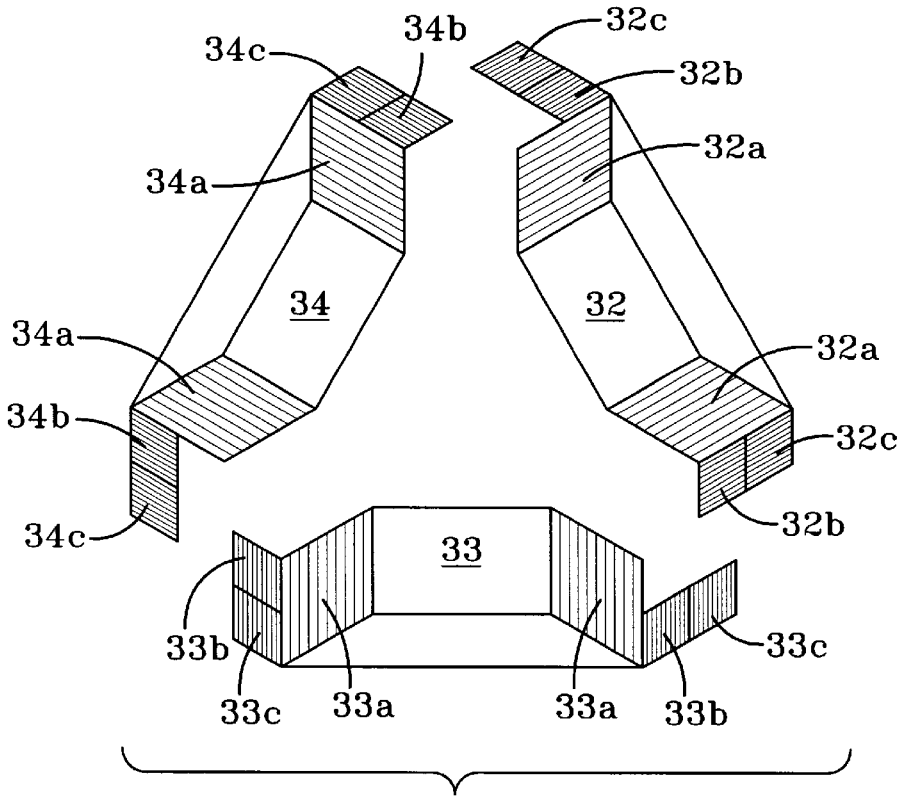
FIGS. 3*a* and 3*b* are transverse cross-sections of an alternative three-phase transformer core with legs with hexagonal cross-section before and after assembly, respectively.
Figure 3B:
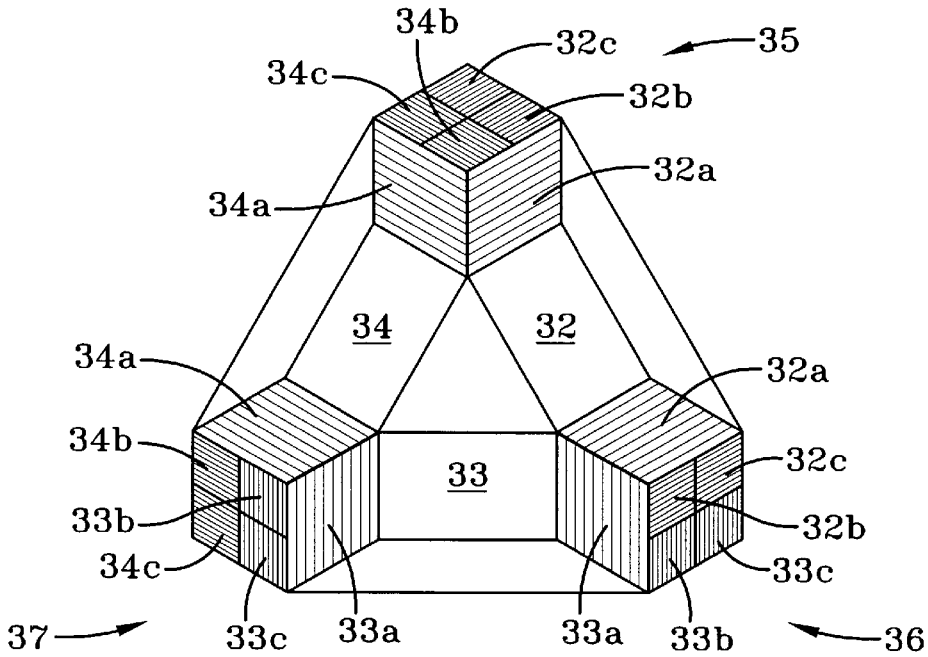
Figure 3C:
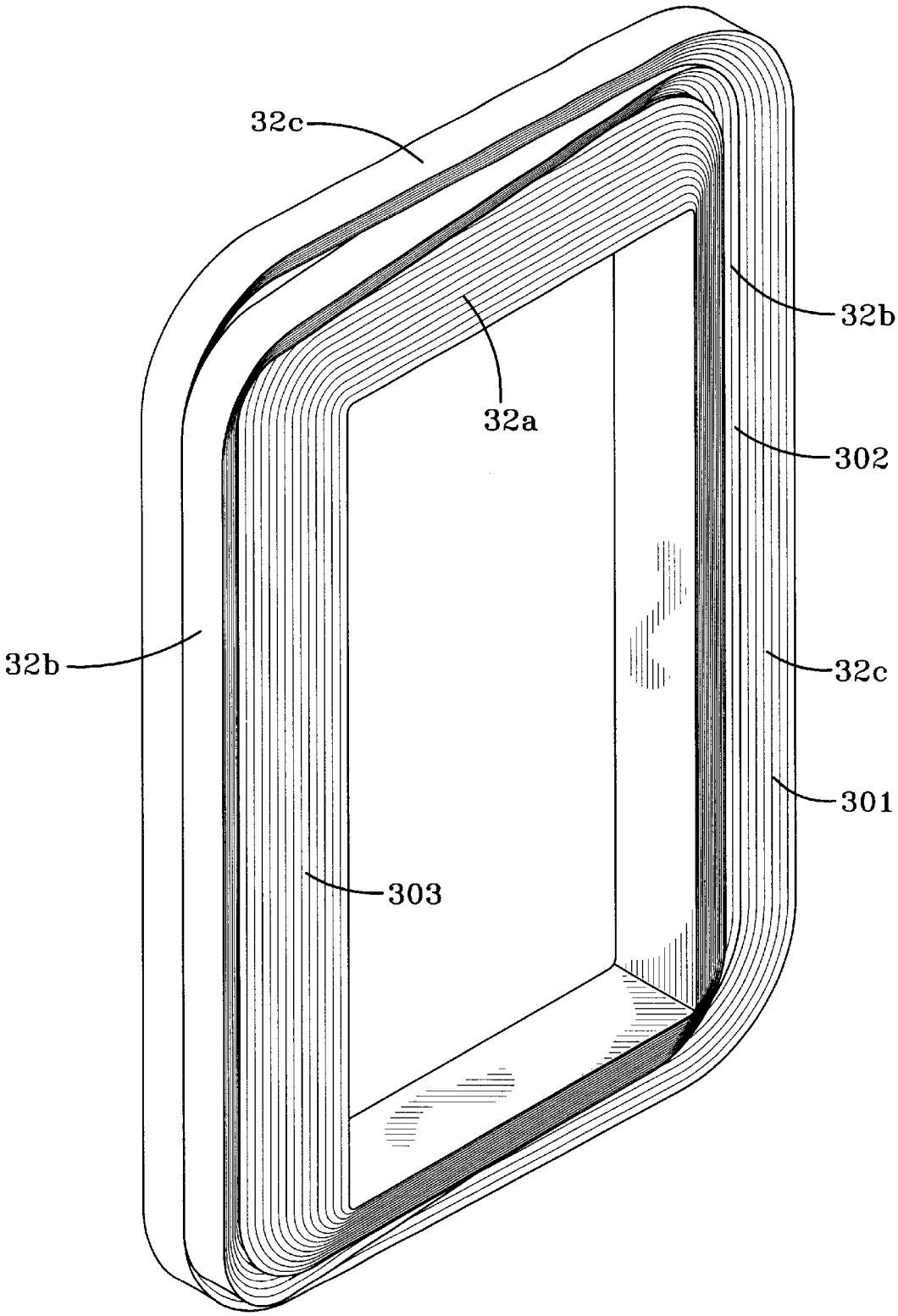
FIG. 3*c* is an isometric view of one of the frames of the transformer core shown in FIG. 3.

Referring first to FIG. 3, a three-phase transformer core 30 is shown. Core 30 has frames 32, 33, 34. Each frame has vertically extending portions that run between opposite ends of a pair of opposed yokes. As explained below, the legs of each frame cooperate with legs of adjacent frame frames to form legs 35, 36 and 37 of transformer core 30. Since each frame is identical to the other frames, only frame 32 will be discussed.

Frame 32 has a broad, thick ring 32*a*, a narrow thin ring, 32*b* which goes partly over ring 32*a*, and a narrow thin ring 32*c* which goes partly over ring 32*b*. Ring 32 is shown alone in FIG. 3*c*. FIG. 3*c* is a rear view of frame 32*a*, viewed from inside core 30. It can be seen in FIG. 3*c* that broad, thick ring 32*a* is lying in one plane, that ring 32*b* has an edge lying on the forward edge of ring 32*a* as viewed on the left portion of FIG. 3*c*, but is located so that the right edge of ring 32*b* is sitting near the rear edge of ring 32*a*. Ring 32*c* has its left hand surface flush against the left hand surface of ring 32*b*, and then is arranged so that it crosses over ring 32*b* and that its offset or splayed surface, labeled 301 is aligned with the offset or splayed surface 302 of ring 32*b*. The right hand edge of ring 32*a* is forward of the splayed portion of ring 32*b*. The splayed surface 303 of ring 32*a* angled in the opposite direction of surfaces 301 and 302.

Figure 3D:
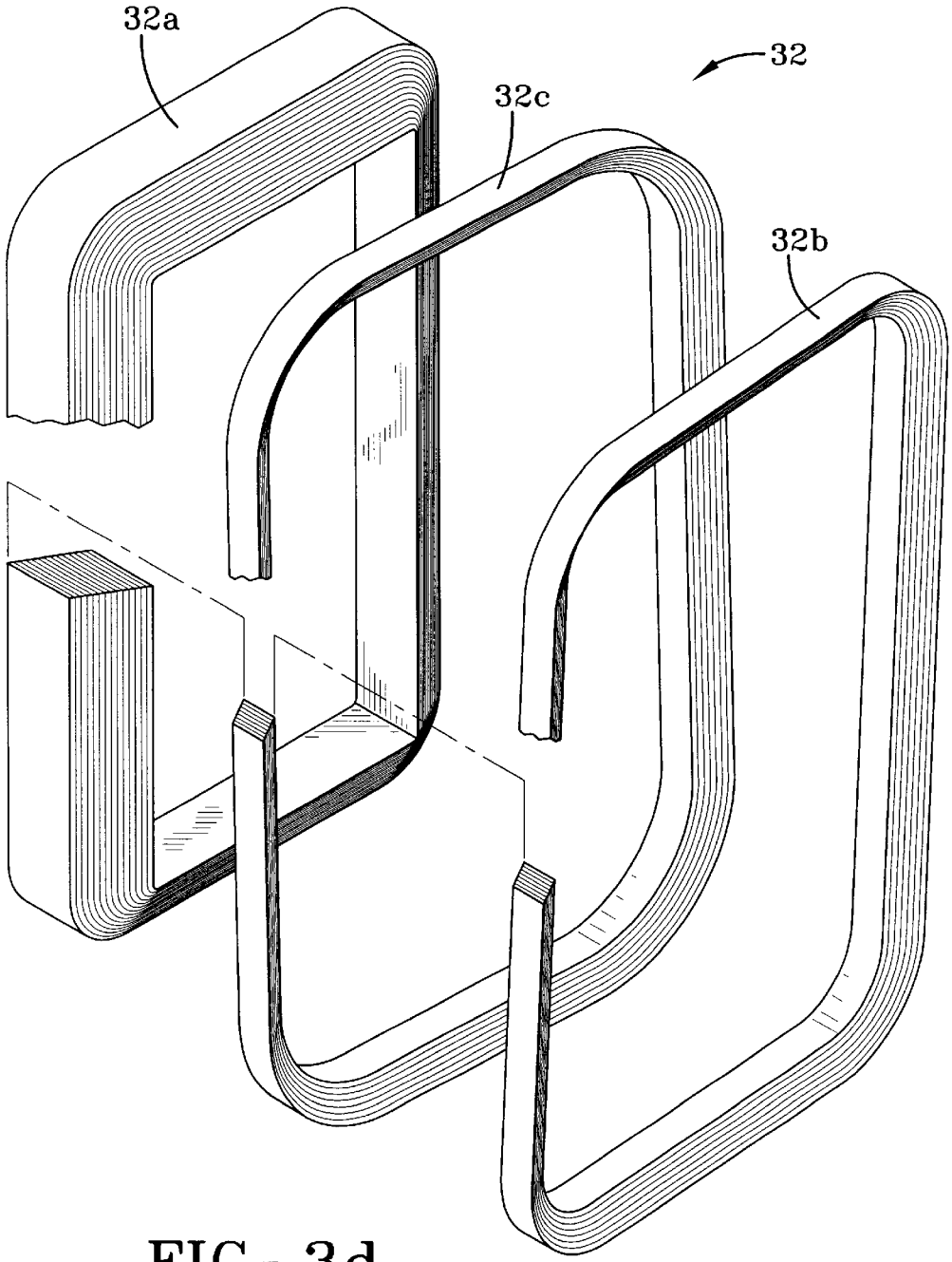
FIG. 3*d* is an exploded view of the frame shown in FIG. 3*c;*
Figure 3E:
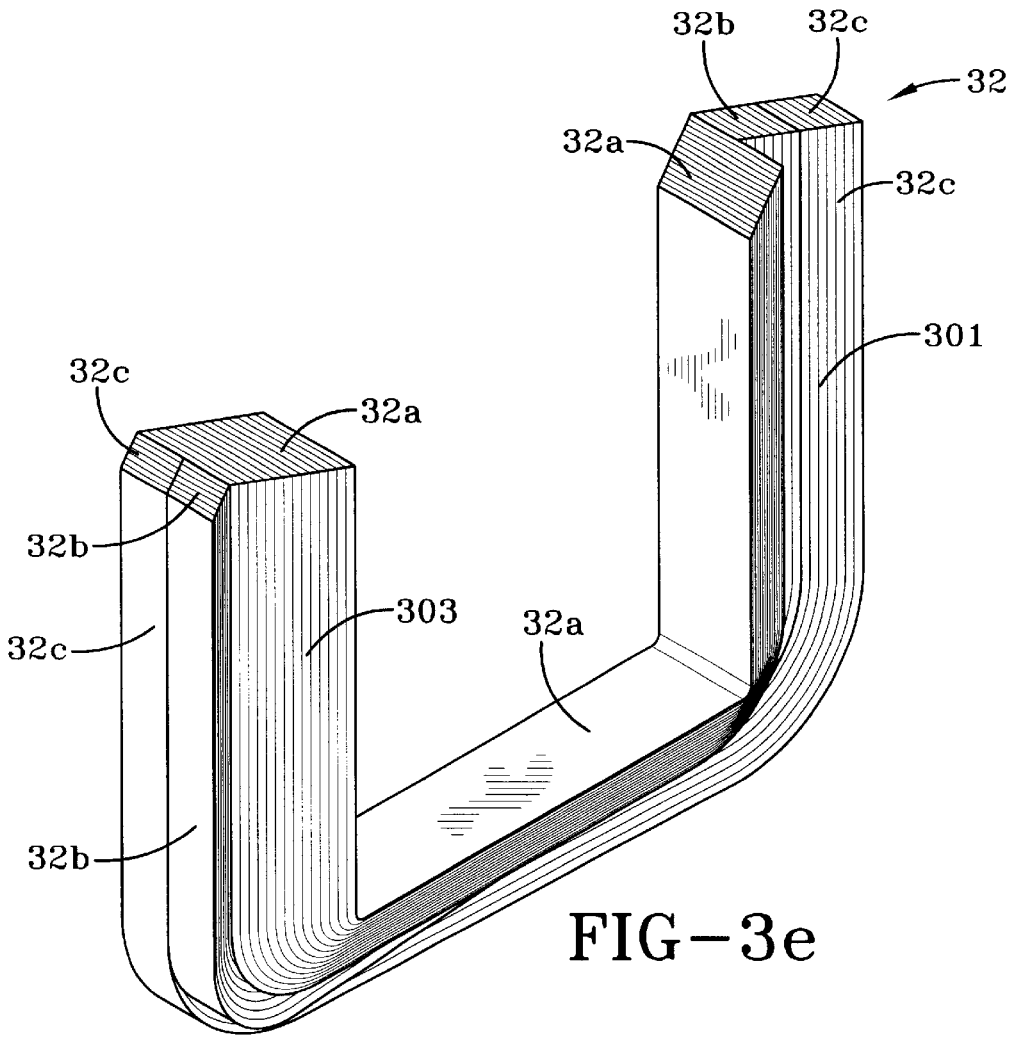
FIG. 3*e* is a cut away isometric view of the frame shown in FIG. 3*c;*

Frame 32 is shown in exploded form in FIG. 3*d*. It can again be seen that broad thick ring 32*a* is a wound ring, with its layers being skewed or inclined so that its innermost strip in the profile extends forwardly, out of the plane of the paper. Narrow thin ring 32*c* has its layers skewed inwardly, towards the plane of the paper, that is, opposite to the direction of the offset of ring 32*a*, as noted above. Ring 32*b* is narrow and thin, and the direction of the offset of its layers is the same as that of ring 32*c*. FIG. 3*e* shows a portion of frame 32 in cross-section. Ring 32*a* is at the innermost part of frame 32, ring 32*b* is close to the forward edge of ring 32*a* when viewed in the left hand corner of FIG. 3*e*, and then extends partly through ring 32*a* as can be seen from the direction of the windings of 32*b* in FIG. 3*e*. The latter is indicated by the angle $\mu$ in FIG. 3*n*. Narrow, thin ring 32*c* is rearward of ring 32*b* as shown in FIG. 3*e*, but is wound around and sits on ring 32*b* as can be seen in the right hand portion of frame 32.

The cross-section shown in FIG. 3*e* on the left-hand portion shows a rhombus 32*a* and two rhomboids 32*b* and 32*c*. A cross-section showing all three frames 32, 33, and 34 is shown in FIG. 3*a*. This will be discussed, briefly, below.

Figure 3F:
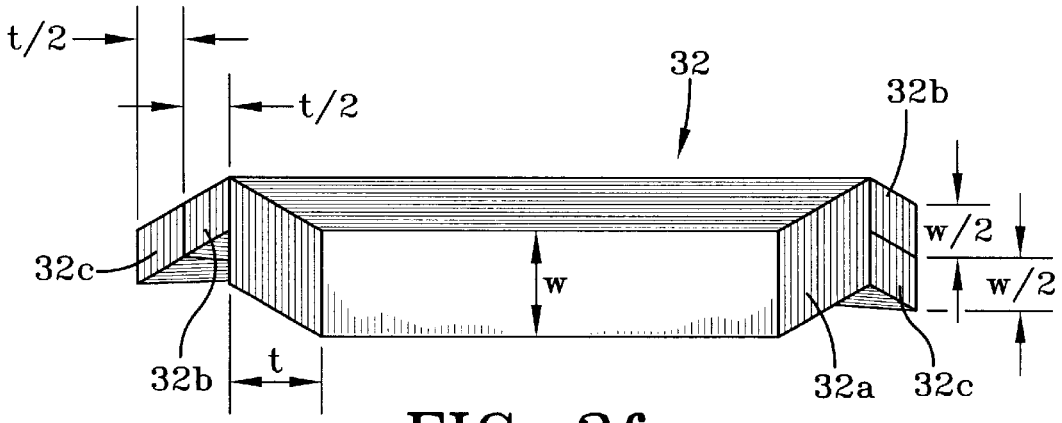
FIG. 3*f* is a cross-sectional view of the frame shown in FIG. 3*c;*

FIG. 3*f* is a top cross sectional view of frame 32 in FIG. 3*c*. It shows broad thick ring 32*a*, narrow thin ring 32*b*, and narrow thin ring 32*c*. The offsetting or splaying of the profiled rings 32*a, b* and *c* is clear from this view. Ring 32*a* is lower in the foreground and higher in the background. Rings 32*b* and 32*c* are higher in the foreground and lower in the background. The dimension "w" shows the width of ring 32*a*, and the width of rings 32*b* and 32*c* are "w/2". The thickness of ring 32*a* is shown as "t" and the thickness of each of rings 32*b* and 32*c* are "t/2".

Figure 3G:
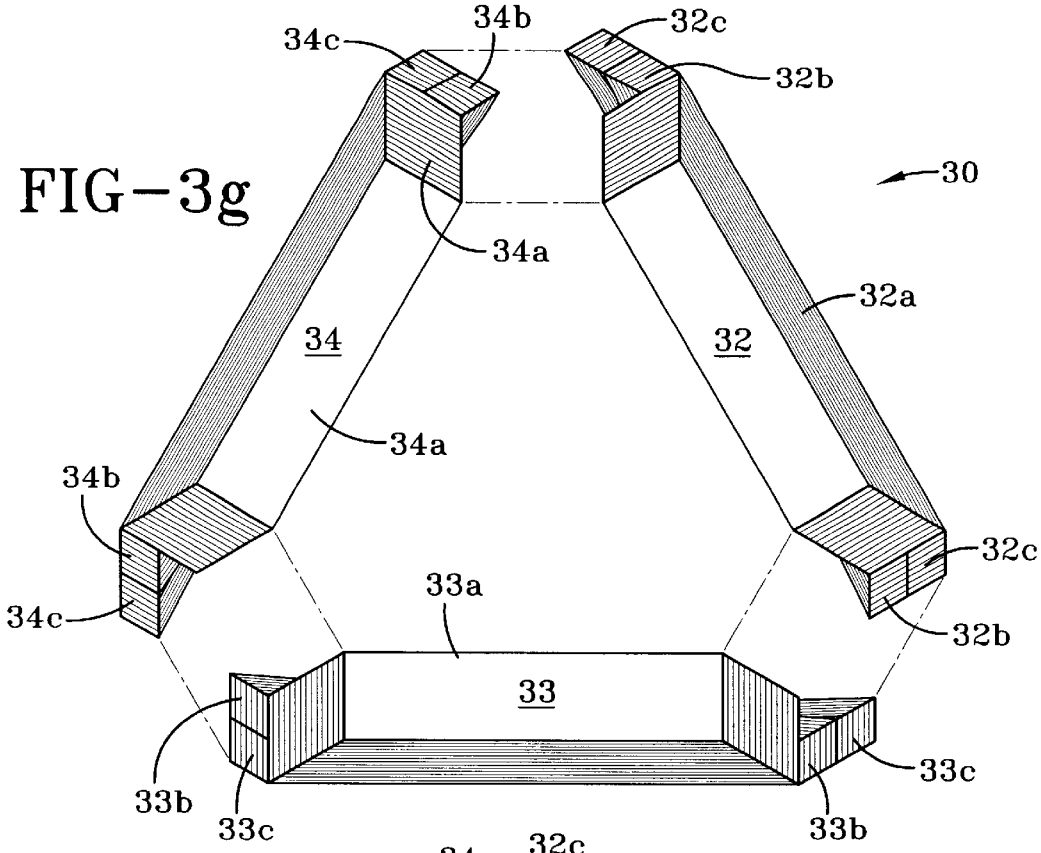
FIG. 3*g* is a transverse cross-sectional view of the three-phase transformer core as shown in FIG. 3 before assembly.
Figure 3H:
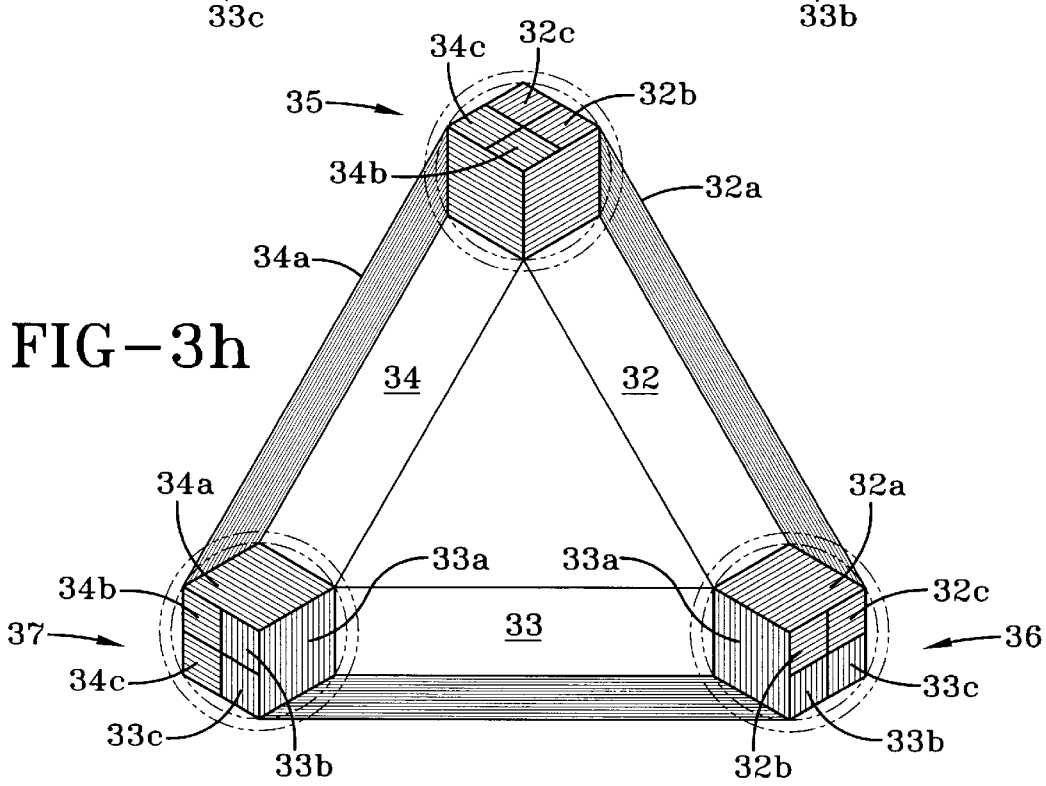
FIG. 3*h* is a transverse cross-sectional view of the three-phase transformer core as shown in FIG. 3 after assembly.

FIG. 3*g* is similar to FIG. 3*a*, and FIG. 3*h* is similar to FIG. 3*b*, and they will be described together. Transformer core 30 is composed of legs 35, 36 and 37. Frame 32 includes broad, thick ring 32*a* and narrow, thin rings 32*b* and 32*c*. Frame 33 has broad, thick ring 33*a*, and narrow thin rings 33*b* and 33*c*. Frame 34 includes broad, thick ring 34*a*, and narrow rings 34*b* and 34*c*.

FIGS. 3*a* and 3*g* shows transformer core 30 in exploded form, and core 30 is shown in assembled form in FIGS. 3*b* and 3*h*, with a cross-section through each of the legs depicted. The cross-section of leg 35 is composed of rhomb 32*a*, rhomb 32*b*, rhomb 32*c*, rhomb 34*a*, rhomb 34*b* and rhomb 34*c*. The cross-section of leg 36 is made of rhomb 32*a*, rhomb 32*b*, rhomb 32*c*, rhomb 33*a*, rhomb 33*b* and rhomb 33*c*. Finally, leg 37 has rhomb 33*a*, rhomb 33*b*, rhomb 33*c*, rhomb 34*a*, rhomb 34*b* and rhomb 34*c*. Each of the cross-sections of legs 35, 36 and 37 is regular hexagons. The hexagon of leg 35 is defined by the bottom side and right edge of rhomb 32*a*, the right side edge of rhomb 32*b* and the right side edge of rhomb 32*c* (the last two edges are aligned to form one side of the hexagon), the edge of rhomb 32*c* and the aligned edge of 34*c*, the left edge of rhomb 34*a* and the lower edge of rhomb 34*a*. The hexagon of leg 36 is defined by the bottom side and right hand edge outside of rhomb 32*a*, the aligned right hand edges outside of rhombs 32*c* and 33*c*, the lower aligned edges of rhombs 33*b* and 33*c*, the lower edge of rhomb 33*a* and the left hand edge of rhomb 33*a*. Finally, the hexagon of leg 37 is defined by the upper right hand side and edge of rhomb 34*a*, the inner side of rhomb 33*a*, the bottom edge of rhomb 33*a*, the aligned bottom edges of rhombs 33*b* and 33*c*, the aligned left-hand of rhombs 34*c* and 34*b*, and the upper left hand edge of rhomb 34*a*.

Figure 3I:
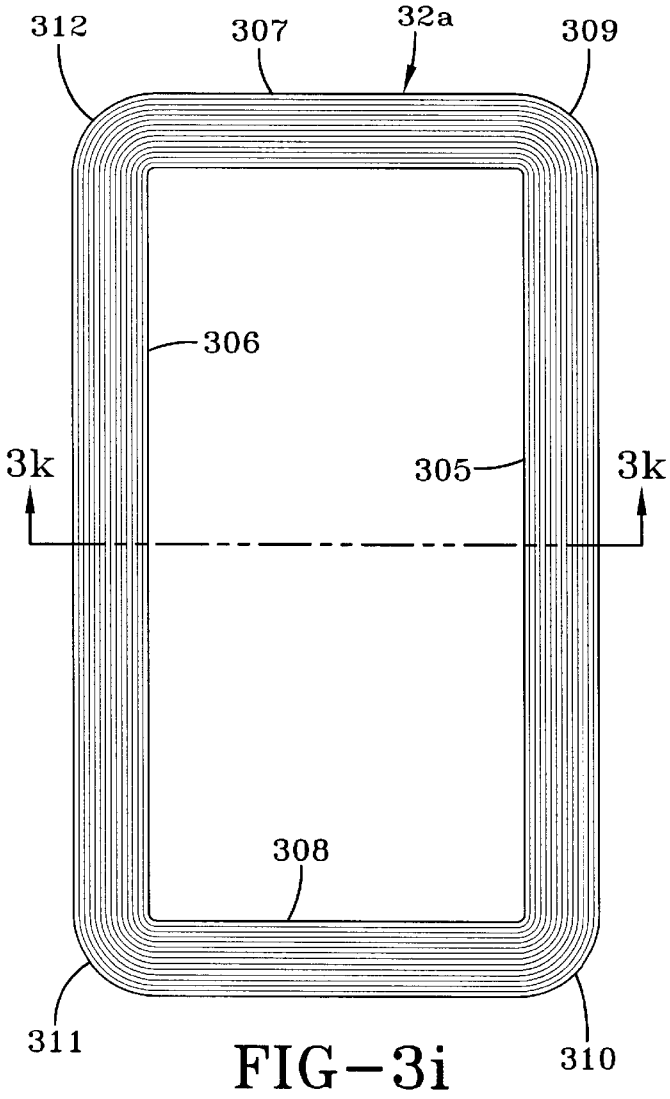
FIG. 3*i* is a front view of one of the rings forming part of the frame shown in FIG. 3*c;*
Figure 3J:
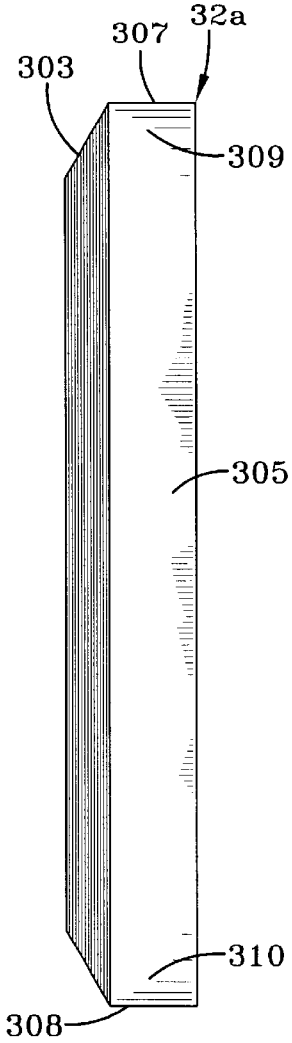
FIG. 3*j* is a side view of the ring shown in FIG. 3*i;*
Figure 3K:
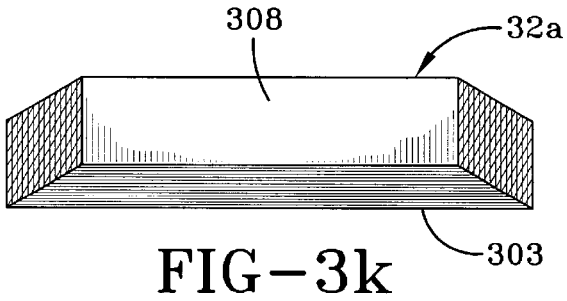
FIG. 3*k* is a cross-sectional view taken in the direction of arrows 3*k*—3*k* in FIG. 3*i;*

Turning next to FIGS. 3*i*–3*k*, ring 32*a*, which is identical to rings 33*a* and 34*a*, is shown in its front, side and cut away views taken in the direction of arrows 3*k*—3*k*. Ring 32*a* includes opposite, parallel leg portions 305, 306, opposing yoke portions 307, 308 and rounded corners 309–312. The offset or splaying is shown in the profile 303.

Figure 3L:
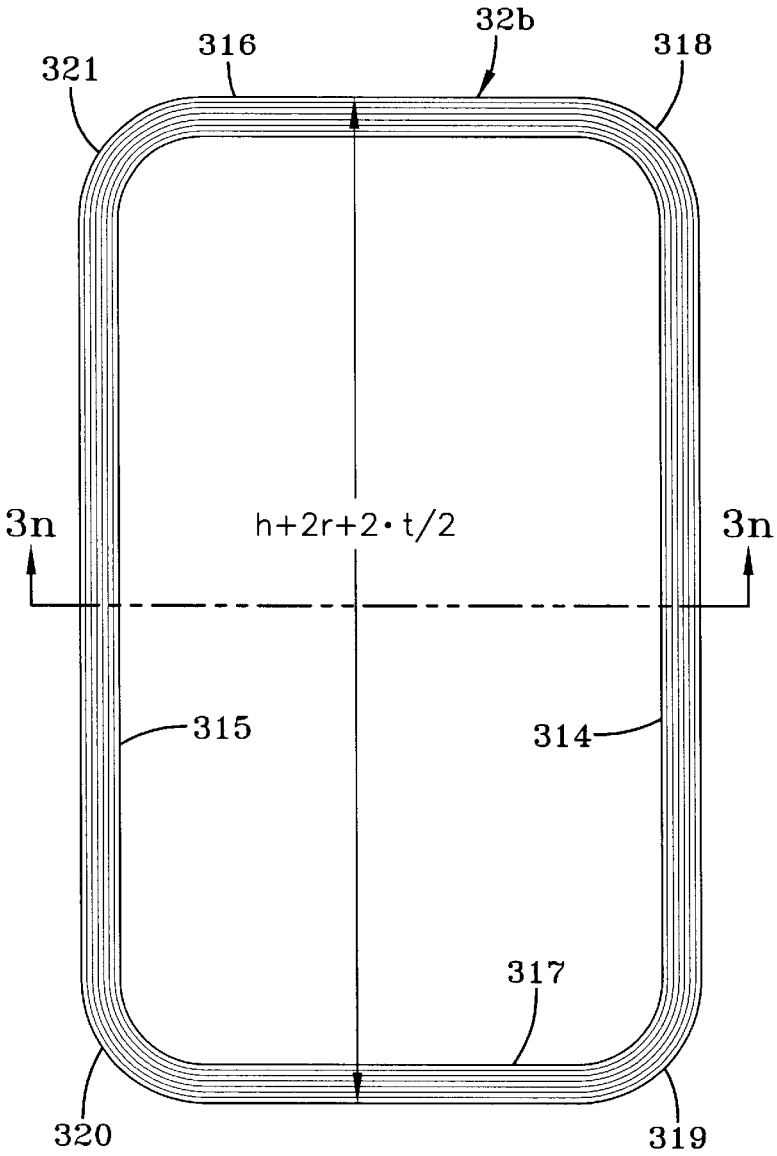
FIG. 3*l* is a front view of another of the rings forming part of the frame shown in FIG. 3*c;*
Figure 3M:
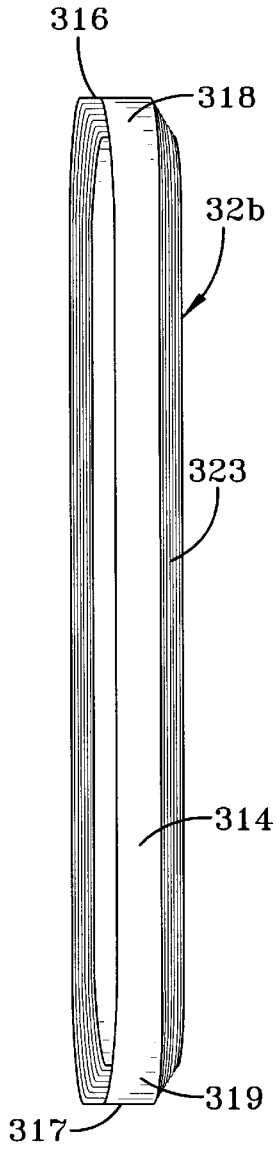
FIG. 3*m* is a side view of the ring shown in FIG. 3*l;*
Figure 3N:
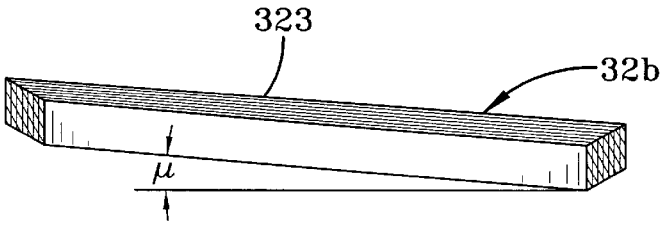
FIG. 3*n* is a cross-sectional view taken in the direction of arrows 3*n*—3*n* in FIG. 3*l;*

Narrow thin ring 32*b*, which is identical to 33*b* and 33*c*, is shown in FIGS. 3*l*–*n*. FIG. 3*l* shows a front view of 32*b*, FIG. 3*m* shows a side view of 32*b* and FIG. 3*n* shows a cross-sectional view taken in the direction of 3*n*—3*n*. Ring 32*b* has opposing, parallel legs 314, 315, and opposing yokes 316, 317. Ring 32*b* has rounded corners 318–321. Ring 32*b* is turned as it passes partly through broad thick ring 32*a*, and this is shown by the angle $\mu$ in FIG. 3*n*. The offsetting or splaying of the wound layers of 32*b* is shown at 323. It should be observed that the offset of the profile shown in FIGS. 3*l*–3*n* is in the opposite direction from that of ring 32*a* shown in FIGS. 3*i*–3*k*.

Figure 3O:
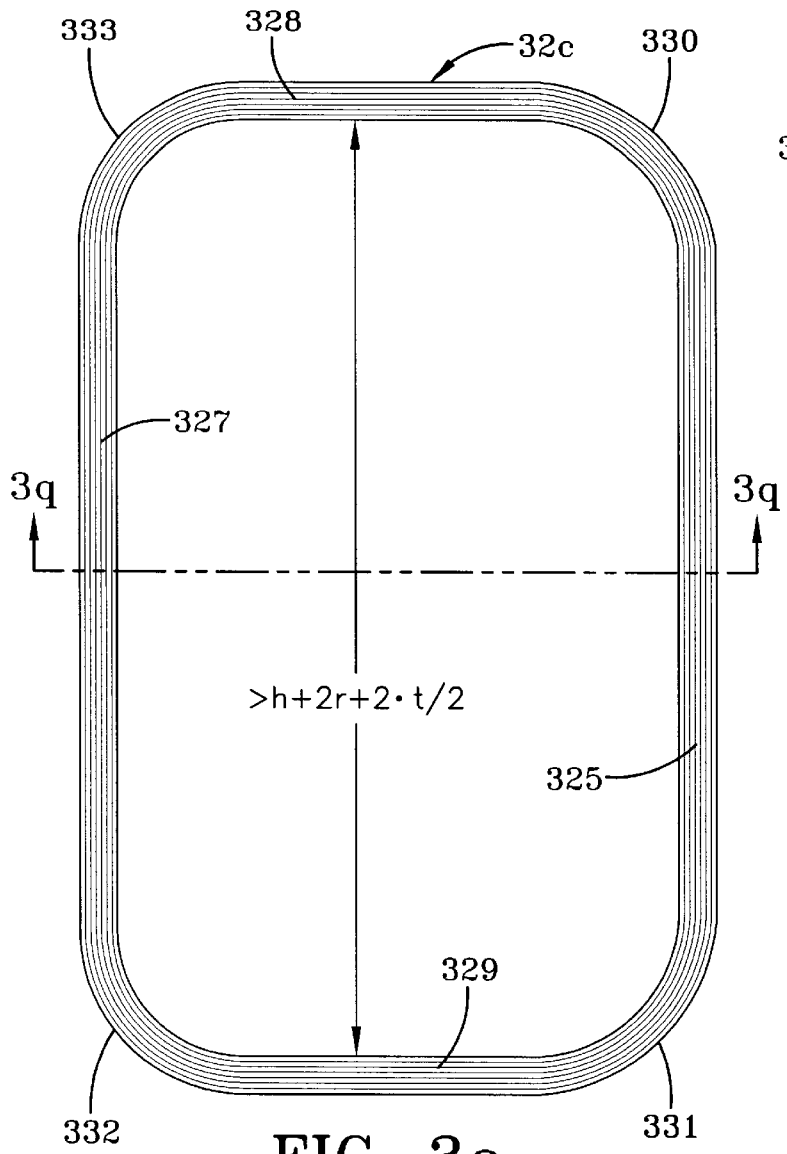
FIG. 3*o* is a front view of another of the rings forming part of the frame shown in FIG. 3*c;*
Figure 3P:
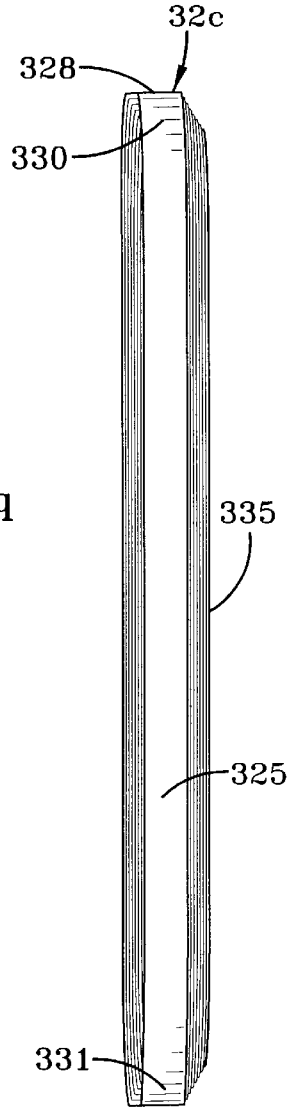
FIG. 3*p* is a side view of the ring shown in FIG. 3*o;*
Figure 3Q:
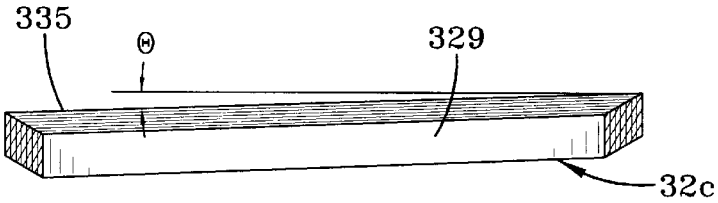
FIG. 3*q* is a cross-sectional view taken in the direction of the arrows 3*q*—3*q* in FIG. 30.

Front and side views of ring 32*c* (which is identical to rings 33*c* and 34*c*) are shown in FIGS. 3*o* and 3*p*. FIG. 3*q* is taken in the directions of arrows 3*q*—3*q* in FIG. 3*o*. Ring 32*c* has leg portions 325, 327, which are opposing and parallel to each other. Parallel yoke portions 328, 329 oppose each other. Rounded corners 330–333 join the yokes and legs. The rings of transformer plate are offset or splayed are shown in FIGS. 3*o*–3*q* at 335. It can be seen that the direction of the profile of offset portion 335 is to the right as viewed in FIG. 3*p*, which is the same as the direction of the profile of ring 32*b* shown in FIG. 3*m*. The turning is in the opposite direction reversed with respect to ring 326.

The rhombic space outside of the basic rings described with reference to FIGS. 2, 2*a* and 2*b*, could thus be filled in accordance with a couple of basic principles. The second embodiment was just described with reference to FIGS. 3 and 3*a* through 3*q*. In other words, the core, generally designated 30, has the same general shape as the first embodiment described above. However, in this embodiment the core comprises three identical frames 32–34, as explained above of which the rightmost one 32 will again be briefly described. The frames 32–34 are similar to the part 23 described in connection with FIG. 2. Referring to FIGS. 3*a* and 3*g* in the first leg 35, the leg part of frame 32 comprises the broad thick ring 32*a* and two narrow thin or low rings 32*b*, 32*c* wherein ring 32*c* is wound outside of ring 32*b*, and the leg part of frame 34 with broad thick rings 34*a*, and side-by-side narrow thin rings 34*b* and 34*c*. In the second leg 36, the leg part of frame 32 has the broad thick ring 32*a*, and the two narrow thin rings 32*b*, 32*c* placed one beside the other. Leg 37 has the leg part of frame 33 with broad thick ring 33*a*, narrow thin rings 33*b*, 33*c*, and leg part of frame 31 with broad thick ring 34*a* and narrow thin rings 34*b*, 34*c*.

The two other frames 33,34 are identical to the first one 32. Thus, the production of the core can as a rule can be simplified, depending on the production volume, because all three frames 32–34 can be made from the same mould.

A further possibility is to make broad thin rings and turn the leg parts 60°, forcing a corresponding bending of the yoke parts. The yoke parts then require more space and the bending is not so easy to effect. Making narrow thick rings and turning and bending as mentioned is also possible, but difficult. Additional variants, including those with smaller divisions, are also possible.

A core with octagonal legs, generally designated 40, will now be described with reference to FIGS. 4 and 4*a*. In an octagonal cross-section, see e.g. the back leg 45, the sides turn 45°, which means that they have a relative angle of 135° to each other. Three rhombs 42*a*, 44*a*, 44*c* each with an angle of 45°, thus get space in the innermost edges of the legs of the core. Outside of these rhombs, rings 42*b*, 44*b* with quadratic cross-sections fill two squares. Finally, a rhomb fills the rest of the octagonal cross-section of the leg shown at 42*c*.

From these six cross-subsections, three subsections compose the cross-section of a leg part of frame 42 going to the second leg 46. The remaining subsections compose the cross-section of a frame 44 going to the third leg 47. There is a frame 43 connecting the second and third legs 46, 47.

The three frames all contain two rings with equal leg parts. A first set of rings 42*a*, 43*a*, 44*a* each has a rhombic cross-section and the yoke parts bent 15°. A second set of rings 42*b*, 43*b*, 44*b*, outside of the respective first rings 42*a*, 43*a*, 44*a* is a quadratic and follows the form of the first set of rings 42*a*–44*a*.

Using a solution from the embodiments with hexagonal legs described with reference to FIGS. 2, 2*a*, 2*b* and 3, 3*a*–3*q* two outer rhombs compose the cross-section of an outer ring with the yoke parts bent 15°. Alternatively, two inner rhombs compose an inner ring but bent 60°. The next ring must now give an outer rhomb in one leg and an inner rhomb in the other leg and be bent 30°. One type of profiled ring is to be preferred because it is difficult to bend a ring 60° and one can not avoid a ring with both an outer rhomb and an inner rhomb.

In frame 42, the third ring 42*c* has a rhombic cross-section in the leg parts and is placed outermost in the back leg 45 but inside the right leg 46. These rhombs of the leg parts are obtained by displacing the outer strips of the ring to the right at the right leg 46 and to the left at the back leg 45. Furthermore, the legs are turned asymmetrically 30° and the yoke parts are bent accordingly. The ring is given such a circumference that it will lie outside of the other rings. The final result appears in FIG. 4.

A 10-sided decagon leg, generally designated 50, will now be described with reference to FIG. 5. The profiled (or offset or splayed) frames contain all four rings with equal leg parts. A first ring 50*a*, a second ring 50*b* and a third ring 50*c* with rhombic cross-sections in their leg parts are attached to the 10-sided cross-section. Thus they have the angles 36, 72, and 108° and their yoke parts bent 24°, causing a 48° bending of its yokes. A fourth ring 50*d* having a rhomboid cross-section with the angle 36° lies mainly upon the first ring 50*a*. Its leg parts are turned outward 24°, causing a 48 degrees bending of its yokes. The fourth ring 50*d* also causes the yoke parts of the third ring 50*c* to make a larger bow to give space. A fifth ring 50*e* has a rhombic cross-section in its leg parts with the angle 144° when it lies outside of the third ring 50*c*, but the ring has a rhombic cross-section with the angle 72° when it lies outside of the fourth ring 50*d*. The yokes are bent only 12°. The arrows in the figure indicate that the cross-sections 50*e* belong to different frames. There will also be a channel 51 suitable for cooling the legs. In an alternative embodiment, the channel is filled with a ring. This is an advantage when the rings co-operate by letting the magnetic field go between them. The space can e.g. be disposed of in such a way that the upper part of the rings 50*c* obtains new rhombic cross-sections with the angle 72°, causing the channels 52*a* and 52*b* to be formed. Further parts of the ring 50*c* to the right can be pushed to ring 50*e*, which forms the spaces 53*a* and 53*b*.

Figure 5:
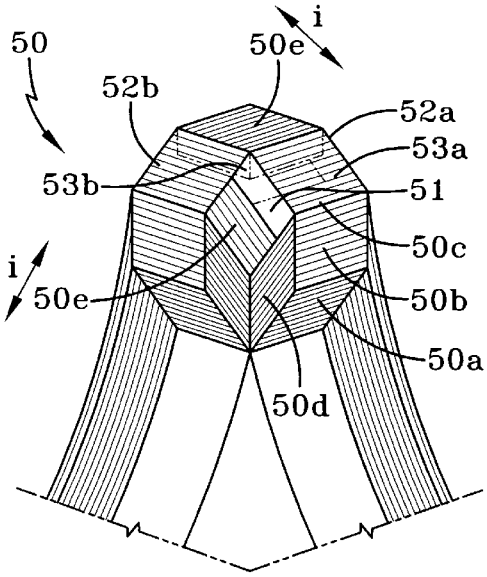
FIG. 5 is a cross-section of a transformer leg according to the invention whose legs have ten edges.

FIG. 5 shows one-third of the core. There are two other identical legs, but rotated 120° and 240°, respectively.

Figure 6:
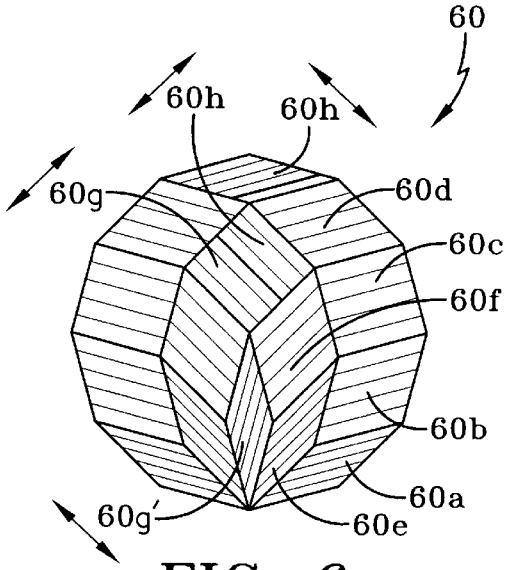
FIG. 6 is a cross-section of a transformer leg pursuant to the invention with twelve edges.

It is possible to provide three-phase transformer cores with even more edges. FIG. 6 shows a 12-sided dodecagon leg generally designated 60. The core has two other equal legs, and yokes similar to those shown in FIGS. 4*a* and 5. The frame is composed of four rings 60*a–d with rhombic cross-sections with the angles* 30, 60, 90, and 120°, which are attached to the 12-sided cross-sections with the angles 30 and 60°, respectively, and turned outward 15°. Attached to the fifth and sixth rings 60*e*, 60*f* there is space for a ring 60*g* with a rhombic cross-section with the angle 30° turned outward 45°. Its other leg part is a rectangle outside of the sixth ring 60*f* and turned outward 15°. Inside of these rings there are two rings 60*e*, 60*f* with rhombic cross-sections with the angles 30 and 60°, respectively, and turned outward 15°. Upon the ring 60*d* there is space for a ring 60*h* with a rhombic cross-section with the angle 150° and the other leg part is a rectangle attached to ring 60*d* and outside ring 60*f*. The whole cross-section is then filled. Yoke parts are separated by giving some wider bows to give space for other yoke parts. Giving some wider bows to give space for other yoke parts separates yoke parts.

Figure 7:
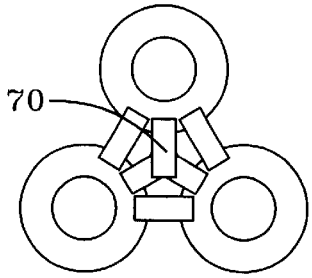
FIG. 7 is a top view of an arrangement for influencing the leakage inductance and the harmonics in a three-phase transformer.

The good properties of these transformer cores can be made even better for some transformer applications, see FIG. 7. The leakage inductance can easily be increased by an additional core 70 of strips between the primary and secondary windings of the transformer. The strips are brought together at the top and bottom. The strips can be spread around the entire primary winding or be concentrated to one place, making the secondary winding eccentric.

The non-linear magnetic properties of iron result in harmonics in the magnetic fields, voltages and currents.

An additional leg placed in the center of the core will not get any magnetic field under perfectly symmetrical and distortion-free three-phase conditions. Common components in the phase voltages, like the third harmonics, will be influenced by a center leg.

Also a combination of strips between the windings and a center leg is possible.

Figure 8:
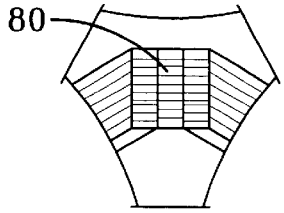
FIG. 8 is a cross-section of a leg in the middle of the core for leakage inductance correction.
Figure 9:
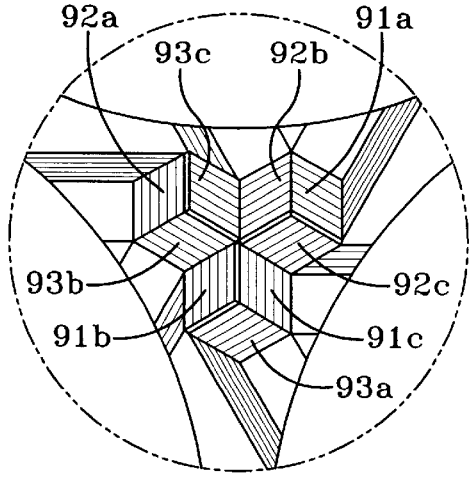
FIG. 9 is another cross-section for leakage inductance correction.

In one embodiment, the center leg is made of three rectangular poles 80 from strips given a height three times the width, laid on each other to a quadratic cross-section, see FIG. 8. This is preferably triangular and a custom made solution contains poles with a rhombic cross-section, of which three are put together to form a packet with the strip edges toward each other in a wave form, see FIG. 9. Three packets are put together with small distances to form a leg with a cross-section approximating a triangle. The ends of the poles are bent outward to reach the yokes. To make the bends possible, spacers between the poles are necessary. The spacers do not influence the magnetic properties because one pole from each packet 91*a–c*; 92*a–c*; 93*a–c* is bent to each yoke. Also the strips are, at least on one side, parallel to the spacers.

A rod, wound of strips in spiral form or as coils, is useful, especially if there are to be air gaps between the center leg and the yokes. The spiral can be made wider at the ends to reduce the air gaps to the yokes.

Figure 10:
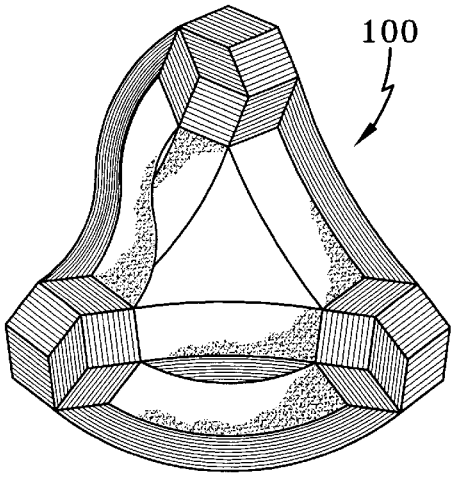
FIG. 10 is a transverse cross-section of a three-phase transformer core with specially shaped yoke parts for improving the magnetic flux.

The flexibility of building cores like this is good and is shown in FIG. 10. The figure shows a core 100 described in connection with FIG. 4, each leg of which forming an octagon in cross-section. A major part of the magnetic flux can pass from one profiled (or offset or splayed) ring to another in the legs where they are touching each other. This enables the rotation of larger fluxes in the yoke triangle.

Figure 11A:
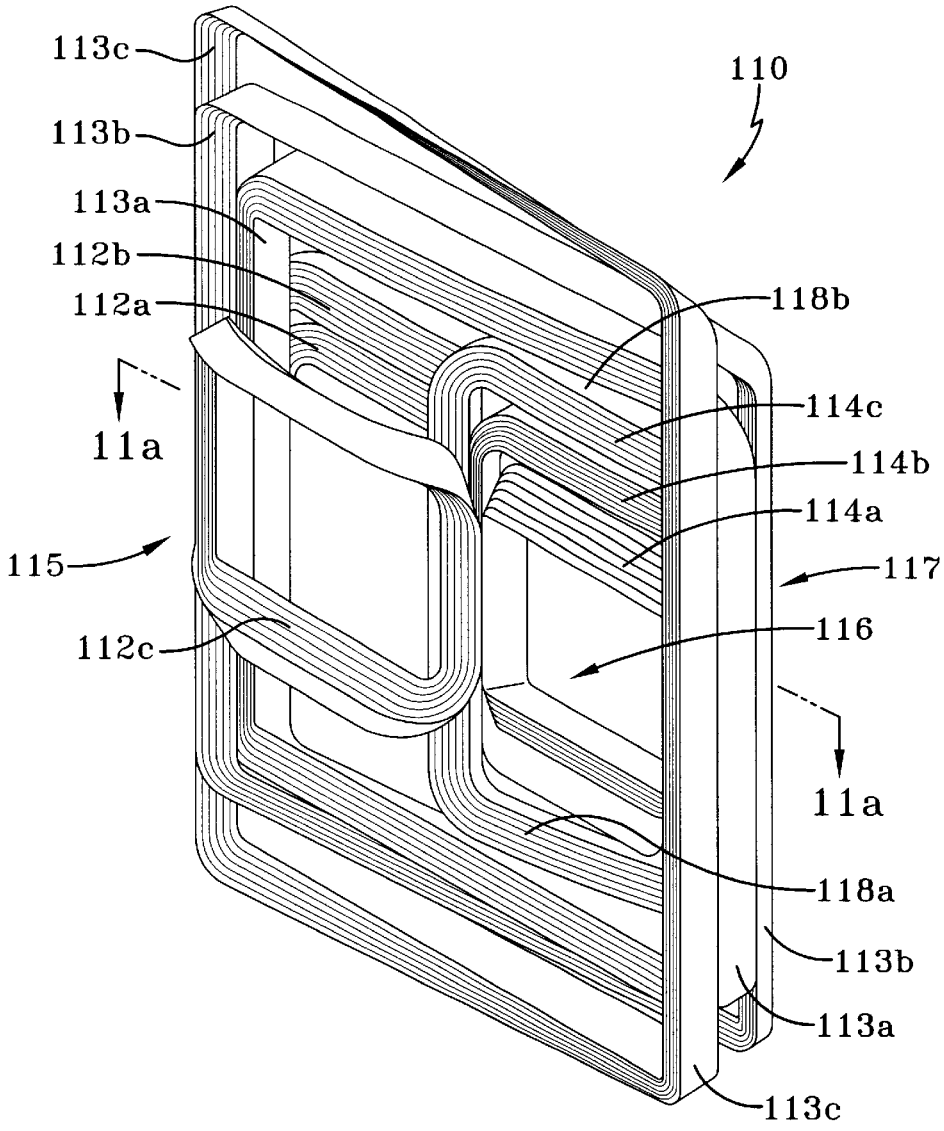
FIG. 11*a* is a cross-sectional view of the transformer core shown in FIG. 11 taken in the direction of arrow 11*a*–11*a;*

With the present invention, it is also possible to provide a three-phase transformer core with lined up legs. This has the advantage that the transformer is narrower that with the delta shaped core. This type of transformer is ideal for placement on e.g. train wagons. FIG. 11*a* shows the transverse cross-section of a transformer core 110 with octagonal legs. All legs comprise four rhombs with an angle of 45° and two squares. Rings running between adjacent legs are shown in the figure while those running between the outer legs are almost entirely hidden. This core has the advantage that it is built with octagonal legs, which fill 90% of the circle in which it is inscribed. Thus, it is valuable to make it as good as possible in all respects, e.g., the possibility to cross over the flux within the legs.

Figure 11A:
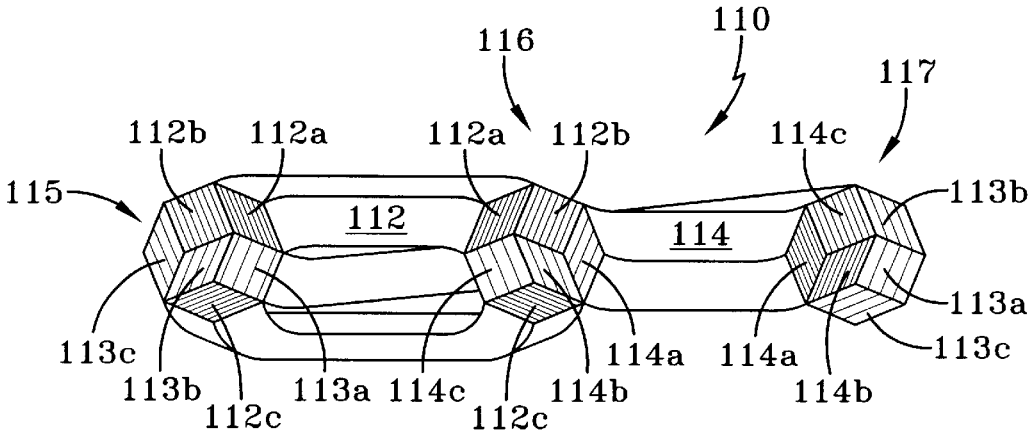

In order to make transformer cores of this kind, the leg parts or portions must be turnable and the yoke parts must be bent and pass each other. There are several solutions, of which one is shown in the figure. The leg parts of the rings are turned outward and the yoke parts inward or vice versa. The shape of the yoke part is limited by the limited possibilities of plastic deformations but otherwise the yoke parts can have any shape. The principle shown in FIG. 11 is to have sharp bends and straight yoke parts. FIG. 11 is an isometric view of a flattened three-phase transformer core 110, with the distances between the yokes enlarged for the purpose of clarity. The core is seen from a direction where the edge between ring 114*a* and 114*b* in leg 116 (described below) is seen in the middle of the leg.

The rings can also be placed on each other giving rounded bends in order to save material.

The yokes between the left leg 115 and the center leg 116 are built up of a ring 112*a* with a rhombic cross-section in the leg part, a ring 112*b* with a square cross-section and both bent 22.5° and a rhombic ring 112*c* turned 67.5° in the leg parts. The rings 112*a* and 112*b* fit into the octagon close to the yoke side while the ring 112*c* fits into the opposing side.

The yoke between the center leg 116 and the right leg 117 can only be placed in the center leg in the remaining positions namely, 114*a–c*. The cross-sections of the left and right legs 115, 117 are mirror images to the center leg 116 so that the rings running in the center leg are symmetric. The inner rings 114*a*, 114*b* have their closest positions in the right leg 117. However, the ring 114*c* with a square cross-section in the leg parts runs to the closest square-shaped position in the right leg. The reason behind that is that the ring 113*a* with a square cross-section between the outer legs is in an outer position on the yoke parts already present in order to reach the left leg.

The twisting of the yokes can be impossible to achieve. In an alternative embodiment, a heavily sloping fold is used instead. This is shown for the ring 114*c* having the shortest yoke. The fold starts at one end of the yoke and ends at the other end, marked by 118*a* for the lower yoke and 118*b* for the upper yoke in FIG. 11. Also, the yokes can be subdivided into several narrow rings.

Thus, one variant is to also let the rings between legs 116 and 117 keep their shape in leg 117 as in leg 116. This has the consequence that the ring with quadratic leg part between the outer legs 115 and 117 must take the innermost quadrate in leg 117. In order to pass the ring with quadratic leg part between leg 116 and 117, a fold on one of the yoke of the ring must be made. The other rings between the other legs 115 and 117 can chose rhombs in the legs, which are turned against each other in order to reduce the twisting of the yokes. It is worth mentioning that an advantage of this variant is that the flux can more easily pass between the rings within the legs.

Figure 12:
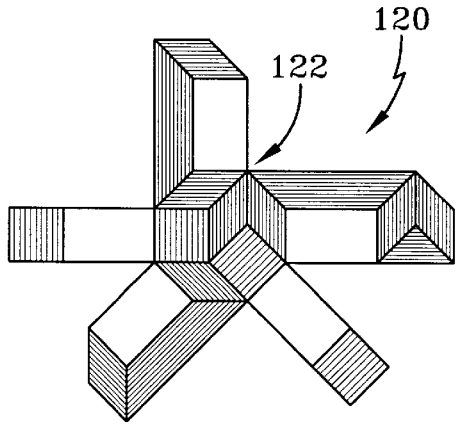
FIG. 12 shows a single-phase shell-type transformer core with one leg in cross-section according to the invention.

Also single-phase transformer cores will be more efficient if they are given polygonal cross-sections. All legs in the cores in FIGS. 4*a* and 10 can be used to make single-phase cores by removing the opposite frame and ignoring the bending of the yokes. These cores have the advantage that the rings extend in a 90° sector. FIG. 12 shows a transformer core 120 with an octagonal cross-section composed of rings with the same cross-sections as in the three-phase transformers but with the return loops going the closest way outside of the windings. Core 120 has a leg 122 with the same cross sections as the three-phase transformer core legs shown in FIGS. 4, 4*a* and 10. By removing one frame, single-phase transformer core legs are obtained. Letting the rings keep their position in the windings is easy to accomplish. Spreading the rings out makes the core lighter. The rings can be turned 45° or 90° within the leg and yet given an octagonal cross-section. A small reduction of the amount of the plate can e.g. be obtained by looping up to the left of the ring looping rightmost in the figure. Its cross-section would have to change to a rhombic form close to rectangular form.

Figure 13:
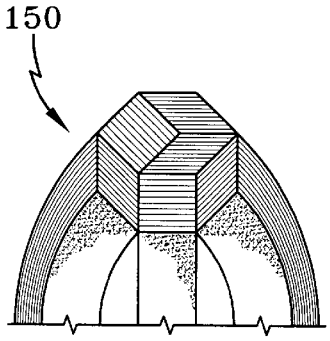
FIGS. 13 and 14 show single-phase core-type transformers with two legs in cross-section according to the invention.

A core with two legs can be made from the three-phase designs by bending the rings from one more leg. A core 150 is shown in FIG. 13 with an octagonal cross-section in its legs. Three leg parts pass through the center of the leg which is suitable for strips resting on each other. The turning of three leg-parts is 45° and the bending is 90°. A ring with a rectangular cross-section and the two rings outside of that ring are not deformed. Cores with hexagonal legs need only three rings made of strips with the same width. By increasing the number of polygons in the legs of transformer cores according to the invention renders them easy to form.

Figure 4A:
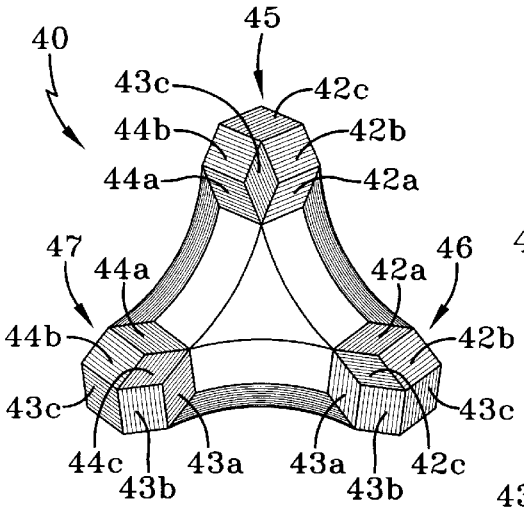
FIG. 4*a* is a transverse cross-section of the core shown in FIG. 4, taken in the direction of the arrows 4*a*—4*a;*
Figure 4:
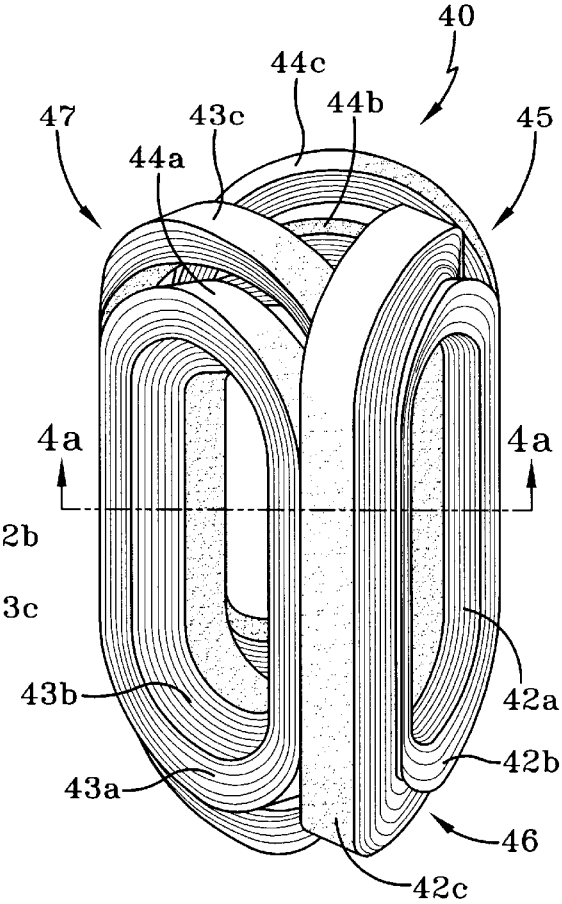
FIG. 4 is an isometric view of a three-phase transformer core with legs that are octagonal in cross-section.
Figure 14:
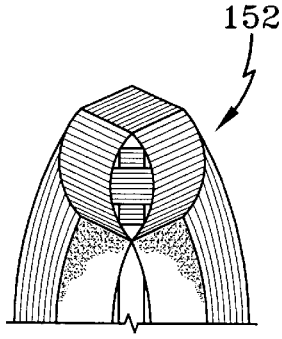
Figure 12A:
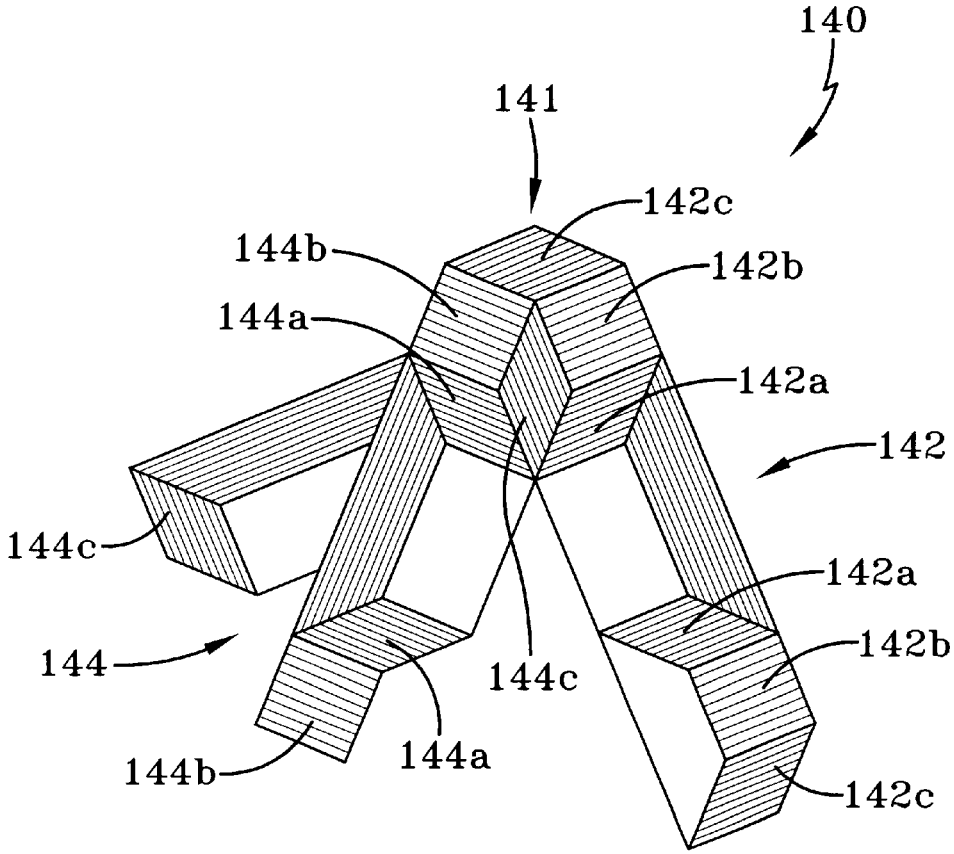
FIG. 12*a* is a variation of the single-phase transformer core according to the invention.

If that octagon edge where three rhomb edges meet is put innermost in the core, as in FIG. 4*a*, e.g. rings 42*a*, 42*b*, 42*c*, 43*a*, 43*b* and 43*c*, and the opposite frame 44 is removed, one obtains a single-phase shell core 140 shown in FIG. 12*a*, the turnings will only be 22.5° except for the rhomb in the middle, which must be turned 67.5° to make the rings meet again. FIG. 12*a* thus shows the development of a single-phase core from a three-phase core, i.e. from the core 40 of FIG. 4*a* to the core 120 of FIG. 12. Single-phase core 140 has a frame 142 showing in a leg 141, rhombs 142*a* and 142*c*, and a square 142*a*. Frame 142 has another leg part with rhombs 142*a*, 142*c* and square 142*b*. Leg 141 further includes a leg part of frame 144, and includes rhombs 142*a* and 142*c*, and a square 142*c*. Rings 144*a* and 144*c* have rhombs 144*a*, 144*c* and square 144*b*. Replacing this rhomb 144*c* with a ring, with steps approximating the rhomb, is more realistic and is shown in the core 152 in FIG. 14. Letting the strips reach the circle, thus increasing the total cross-section makes a further improvement.

It is realised that the single phase transformers described herein also can have a cross-sectional shape deviating from a perfect regular polygon, like the three-phase cores described below with reference to FIGS. 18–21.

Figure 15:
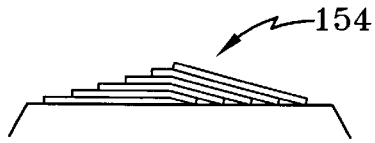
FIGS. 15 and 16 show side views of further improvements of the shape of the transformer core.
Figure 16:
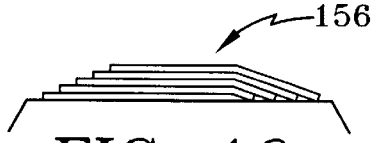

The segments outside of a polygonal leg can be filled by a thin rhombic ring of a strip with about half the width and the full height of the segment and wound to its total width. Folds 154 in the strips along the middle of the rhomb as in FIG. 15 make two sides to one flat side giving a triangle, the sides of which are in contact with the core. With about ⅔ width and ⅚ height, a fold at the edge of the innermost strip makes a trapezoid cross-section 156 as in FIG. 16. The cross-section can also be rounded.

Figure 17:
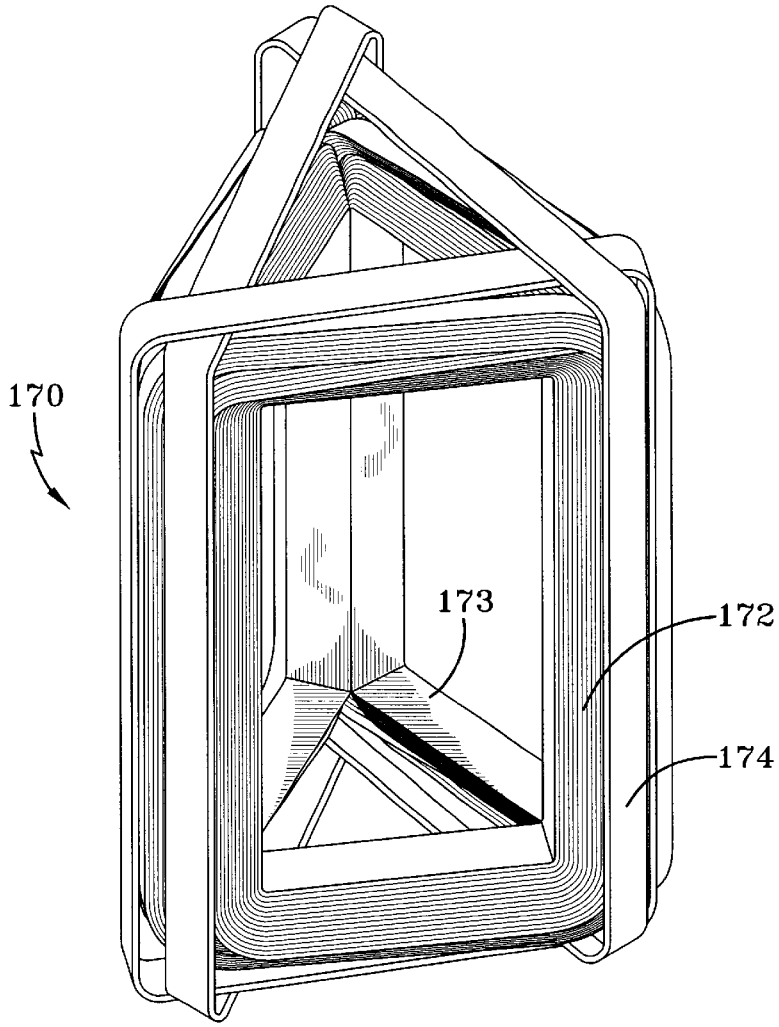
FIG. 17 is an isometric view of a three-phase transformer core according to another embodiment of the invention.
Figure 17A:
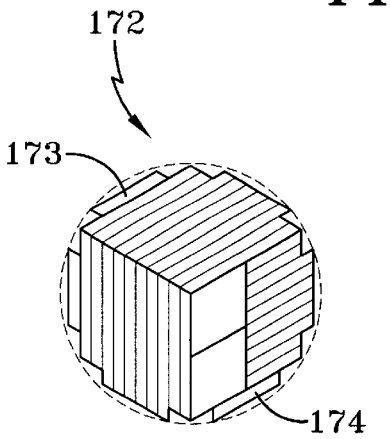
FIG. 17*a* is a cross-section of one of the legs shown in FIG. 17.
Figure 17B:
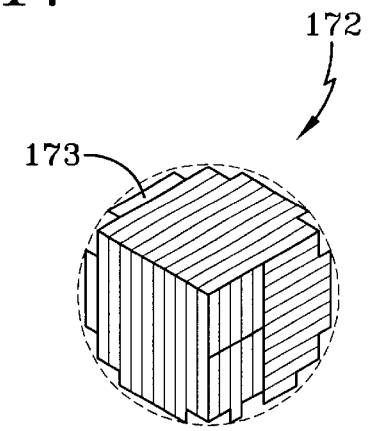
FIG. 17*b* is a cross-section of an alternate leg for the core shown in FIG. 17.

By means of strips of constant width the leg parts can be given a cross-sectional shape closer to the shape of a circle, see FIGS. 17, 17*a* and 17*b*. A core 170 shown in FIG. 17 has a right leg 172 in which will be described as an example with reference to FIG. 17*a*, wherein a transverse cross-section of that leg is shown. Innermost, there are rings 173 of e.g. 80% of full width and to a height of 9% of its width. There are three rings reaching a circumscribed circle, see FIG. 17*a*.

Four of the six segments have been filled with magnetic material, and strips outside of the assembled core can fill the other segments. A ring 174 can be placed on the outer sides of the hexagons. The addition of rings 174 over and under the yokes increases the cooling of the core.

Another embodiment is shown in FIG. 17*b*, wherein the ring 174 has been replaced by broader strips in the other rings.

The transformer cores described above have all in common that the legs are perfectly regular, i.e., the corners thereof can be inscribed in a circle. However, the invention also provides cores with legs that deviate slightly from the above-described regular shapes. Thus, in FIGS. 18 and 19, there are shown three-phase transformer cores with legs having corners that can be inscribed in two circles with different radiuses. Thus, every other corner protrudes from an inner circle. The outer corners can be inscribed in an outer circle. This is shown in FIG. 19, wherein the left lower leg is shown with two different circles touching the corners thereof.

Regularly octagonal legs, such as those used with the embodiment described with reference to FIG. 4, have adjacent edges with a mutual angle of 45° while the angle between the yokes in a transformer core with the yokes in a regular triangle of 60°. This results in bent yokes, such as those shown in FIG. 4, which can be a drawback.

Figure 18:
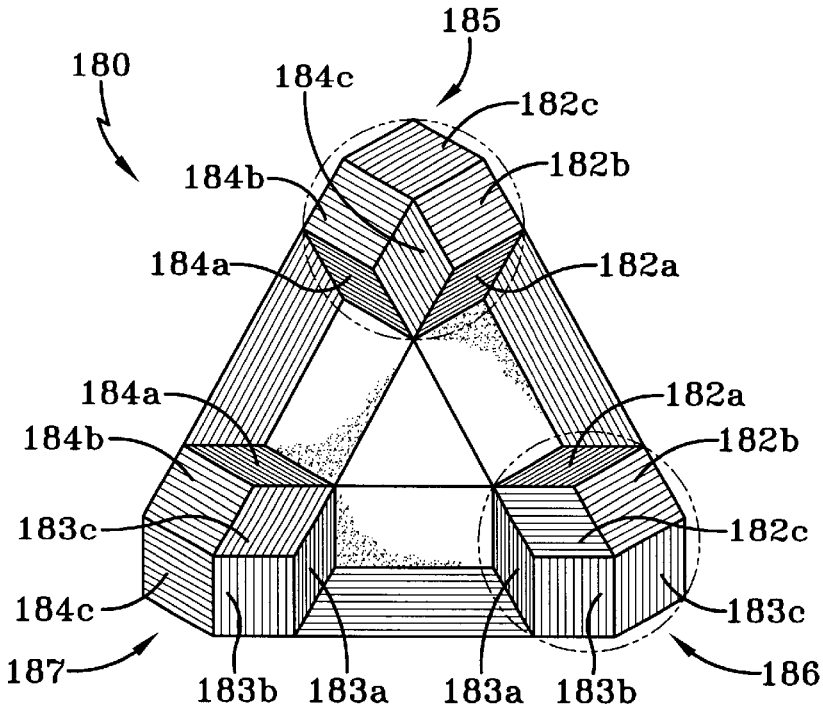
FIGS. 18, 19, 20*a*, 20*b* and 21 a show alternative embodiments of a three-phase core with alternatively shaped legs according to the invention.
Figure 19:
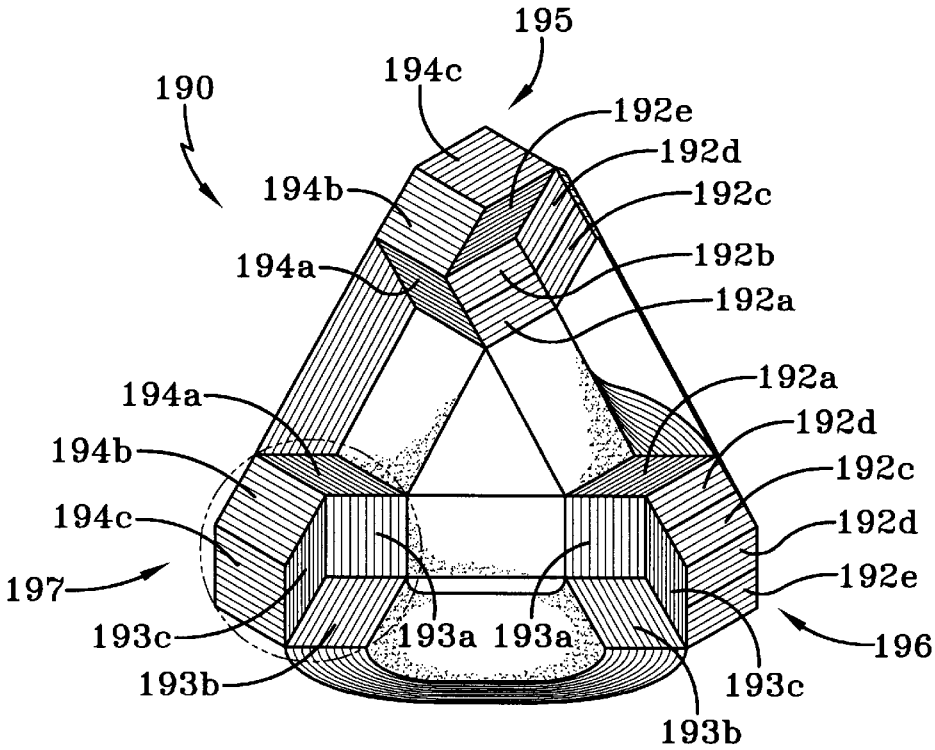

However, if the legs are given a shape like the ones 185, 186, 187 shown in FIG. 18, this problem is overcome. In FIG. 18, every other angle between edges is 30° and the other 60°. This results in an irregular octagon. This can be inscribed in a 1.52° power:

$$x^{1.52}+y^{1.52}=r^{1.52}$$

wherein x and y are two-dimensional co-ordinates and r is the radius of the circle.

If an increase of the transition of the magnetic fields in the legs is desired, the core can be shaped like the core 190 shown in FIG. 19. This core is made up of three rings 194*a*–*c* to the left in the figure, three lower rings 193*a*–*c* and five rings 192*a*–*e* to the right in the figure. The rings shown in FIG. 19 are described in the Tables 1–3 below:

TABLE 1

| Ring | Cross-section in leg 196 | Cross-section in leg 195 | Remarks |
|---|---|---|---|
| 192a | rhombic 30° outwards | Rectangular | |
| 192b | rectangular | Rectangular | Displaced 0.866 of width inwards; located on 192a |

TABLE 1-continued

| Ring | Cross-section in leg 196 | Cross-section in leg 195 | Remarks |
|---|---|---|---|
| 192c | rectangular | Rhomboidal 60° outwards expanded 30° outwards | Located outside of 192a |
| 192d | rhomboidal 60° inwards plane | Rhomboidal 60° outwards expanded 30° outwards | Located on 192c and outside of 192b |
| 192e | rhomboidal 60° inwards | Rhombic 30° outwards | Displaced 0.616 of width inwards located on 192b and 192d |
| 193a | quadratic | | |
| 193b | rhombic 60° outwards | | Outside of 193a |

TABLE 2

| Ring | Cross-section | Remarks |
|---|---|---|
| 193a | Quadratic | |
| 193b | rhombic 60° outwards | Outside of 193a |
| 193c | rhombic 30° outwards | on 193a and 193b |

TABLE 3

| Ring | Cross-section | Remarks |
|---|---|---|
| 194a | Rhombic 30° outwards | |
| 194b | Quadratic | on 194a |
| 194c | Rhombic 60° inwards | on 194b |

The magnetic field can now pass between rhomb and square and square and rhomb, respectively.

In an embodiment not shown in the figures, legs with twelve edges and angles of 60° and 12° are used.

The cross-sectional areas of polygons compared with the circumscribed circle and the hexagons are given in table 4 below:

TABLE 4

| Shape of cross-section | Relative cross-sectional area | Comparison with a circle | Comparison with a hexagon |
|---|---|---|---|
| Circle | 3.1416 | 100 | 120.9 |
| Dodecagon | 3 | 95.5 | 115.5 |
| Decagon | 2.9389 | 93.5 | 113.1 |
| Octagon | 2.8284 | 90.0 | 108.9 |
| Hexagon | 2.5981 | 82.7 | 100 |
| Duo-decagon 60 and 12° | 2.5582 | 81.4 | 98.5 |
| Duo-octagon 60 and 30° | 2.5176 | 80.1 | 96.9 |
| Square | 2 | 63.6 | 77 |

Where angles other than 60 and 30° are chosen in a duo-octagon, the comparison value will be between 96.9% and 108.9%.

Figure 20A:
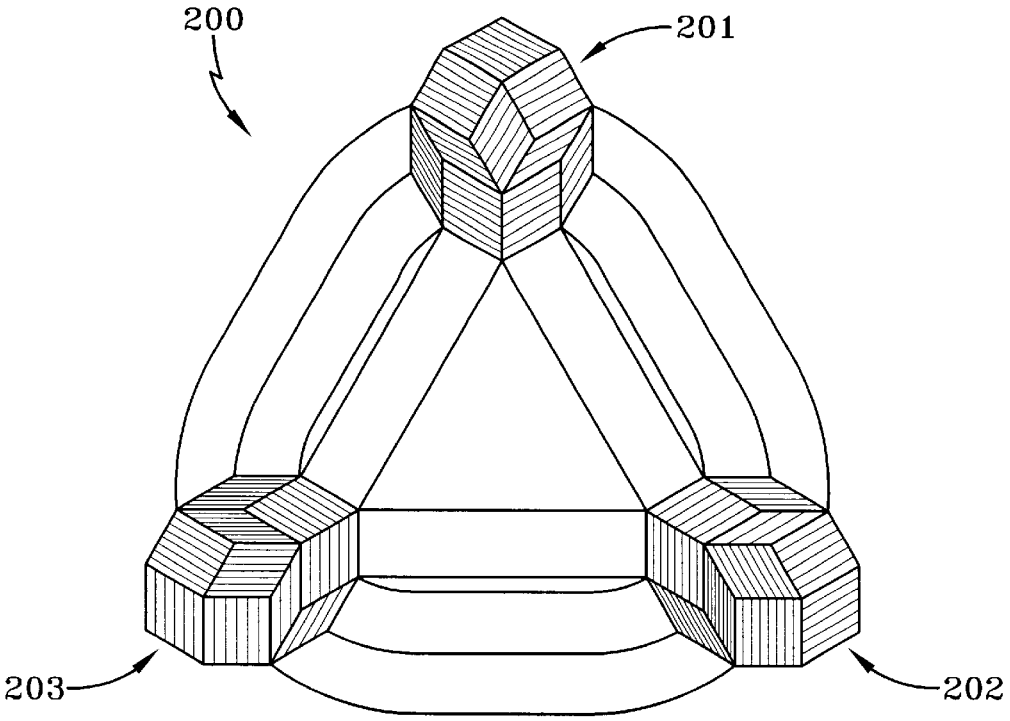
Figure 20B:
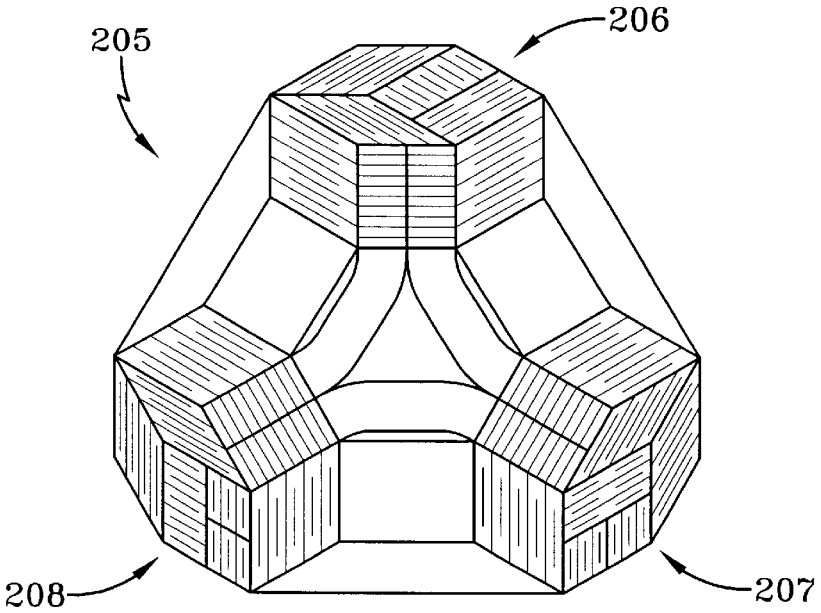

Yet another embodiments are shown in FIGS. 20*a* and 20*b*. The legs shown in FIGS. 20*a* and 20*b* are essentially elliptical polygons, i.e., the cross-section can be inscribed in an ellipse. In FIG. 20*a*, a core 200 with legs 201, 202 and 203 is shown. The cross-section of each leg is a decagon essentially inscribed in an ellipse with the major axis radially out from the center line of the core. In FIG. 20*b*, a three-phase transformer core 205 is also shown. Core 205 has legs 206, 207 and 208. The cross-section of each leg is an octagon essentially inscribed in an ellipse with the minor axis radially out from the center line of the core.

The magnetic field can to a large extent pass from one yoke to another in the legs.

In the embodiments described with reference to FIGS. 18–20*a*, 20*b* the positions of the corners of each leg can be described as being essentially positioned on an imaginary generalised circle defined by orthogonal coordinates x and y according to the following formula:

$$(x/a)^n+(y/b)^n=1$$

wherein, a, b and n are positive numbers.

An embodiment with improved magnetic flux will now be described with reference to FIG. 21*a*, which is a cross-sectional view of a three-phase transformer core 210 and FIG. 21*b*, which is an end view showing a yoke part of a transformer core.

Three rings 212*a*, 213*a* and 214*a* are given a rhombic cross-section with an inner angle of 60° They can then be assembled to triangular yokes and legs with four of the sides and five of the edges of hexagons.

Figure 21A:
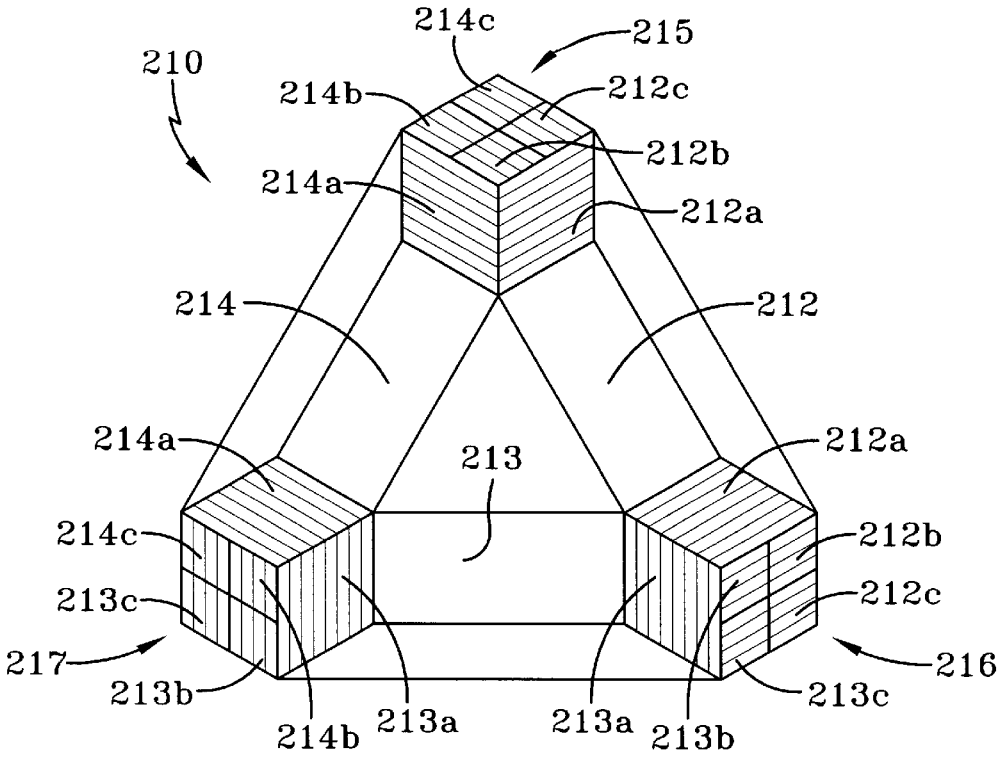
FIG. 21*b* is a plan view of the transformer core shown in FIG. 21*a;*
FIG. 21*c* is a top view of an alternative embodiment of the invention showing a three-phase transformer core with rings added to help in cooling the core.
Figure 21B:
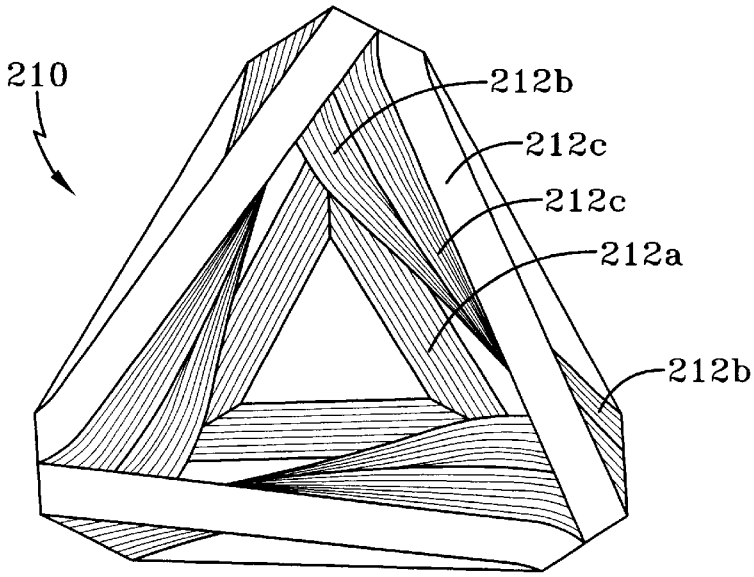

Six low narrow rings 212*b, c*, 213*b, c* and 214*b, c* are assembled outside of the rings 212*a*, 213*a*, 214*a* as shown in FIG. 21*a*. This gives an end view of the yoke part as shown in FIG. 21*b*. The leg portions are turned 60° when they are lying besides each other so that they can then transfer magnetic flux to neighboring rings. However, the bends can deviate slightly from those shown in the figure. The magnetic flux can go in all rings from one yoke to another.

Smoothing of the edges of the legs of the core provides for a smaller play between the core and the rotating bobbin because higher accuracy can be easily achieved during manufacturing. This in turn increases the space for the windings and decreases the load losses. The flow density in the yoke decreases slightly but is still an advantage.

Figure 21C:
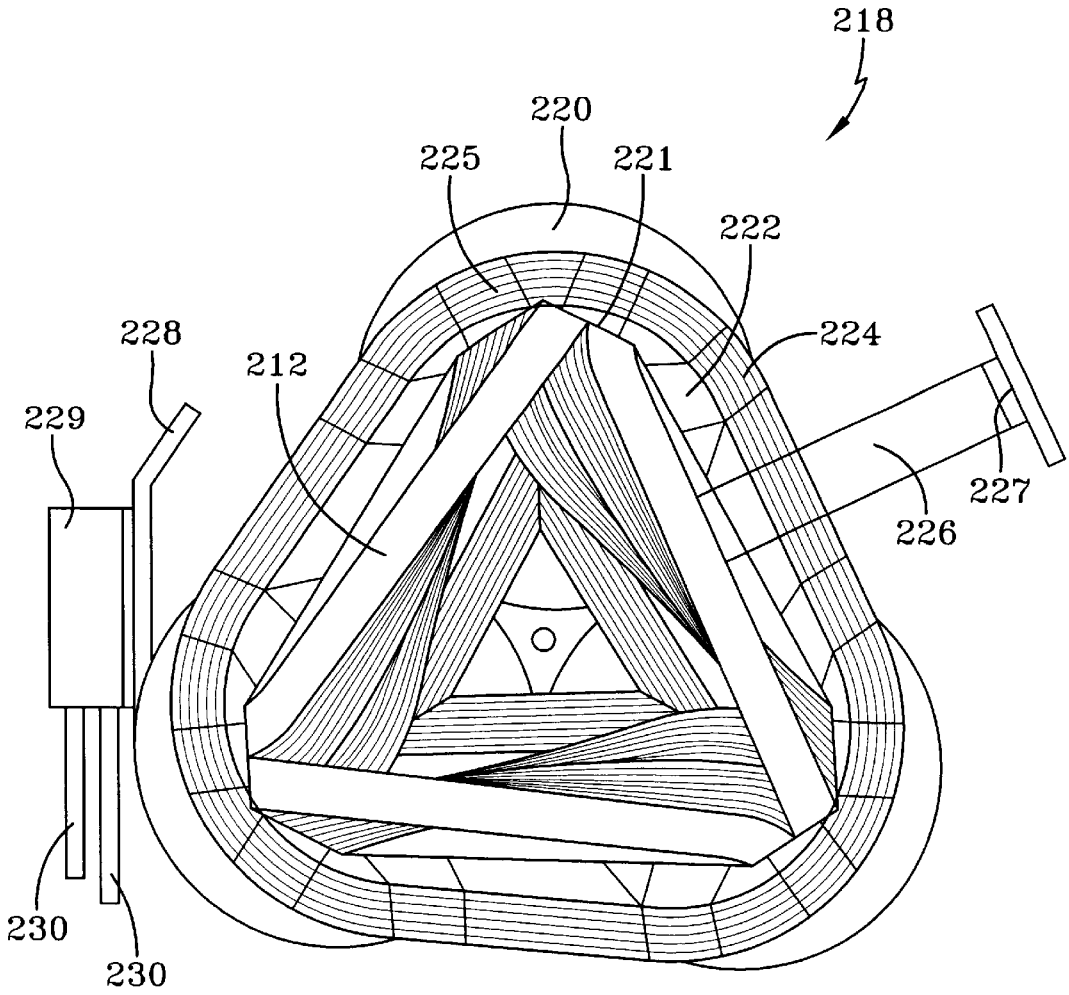

A particularly advantageous three-phase transformer core 218 according to the invention is shown in FIG. 21*c*, which is a combination of the embodiments shown in FIGS. 17 and 21*a,b*. It shows how a three-phase transformer core which has had rings added can also help cooling the transformer. When putting rings on the legs to make its legs more rounded, one can also let the strips transfer heat to the air by connecting these rings at the top and/or bottom of the transformer to a radiator/cooler of strips as shown in FIG. 21*c*.

The core 218 can be provided with windings 220 with segment strips using the principle of FIGS. 17*a–c* using used when strips for filling the segments, but also filling the adjacent segments. The ends of a pair of segment strips 221 and 222 are when necessary bent upwards for cooling and also bent downwards at the bottom. A strip of ferromagnetic material is closely wound to a cooling ring 223 at the top of the core. The ends of the segment strips 221 and 222 are spliced and connected to the strips 224, 225 in the cooling ring 223. Now both magnetic flux and heat are transferred.

Often the transformer is placed within a container. Sometimes the transformer is so hot that the container must be protected from the heat.

Cores of the invention are very silent. Thus they can be connected to heat transferring material 226 to e.g. the container 227 or part of it. This is of interest because the resistance increases with temperature and the power losses increase as well. The transfer of noise from the core will be reduced by bends on the material e.g. aluminum plate.

Also the ends of a set of wires or foils 228 from the windings, especially from a low voltage coil, can with advantage be attached to some cooling device 229, e.g. cooled from water circulating within it via pipes 230.

Figure 22A:
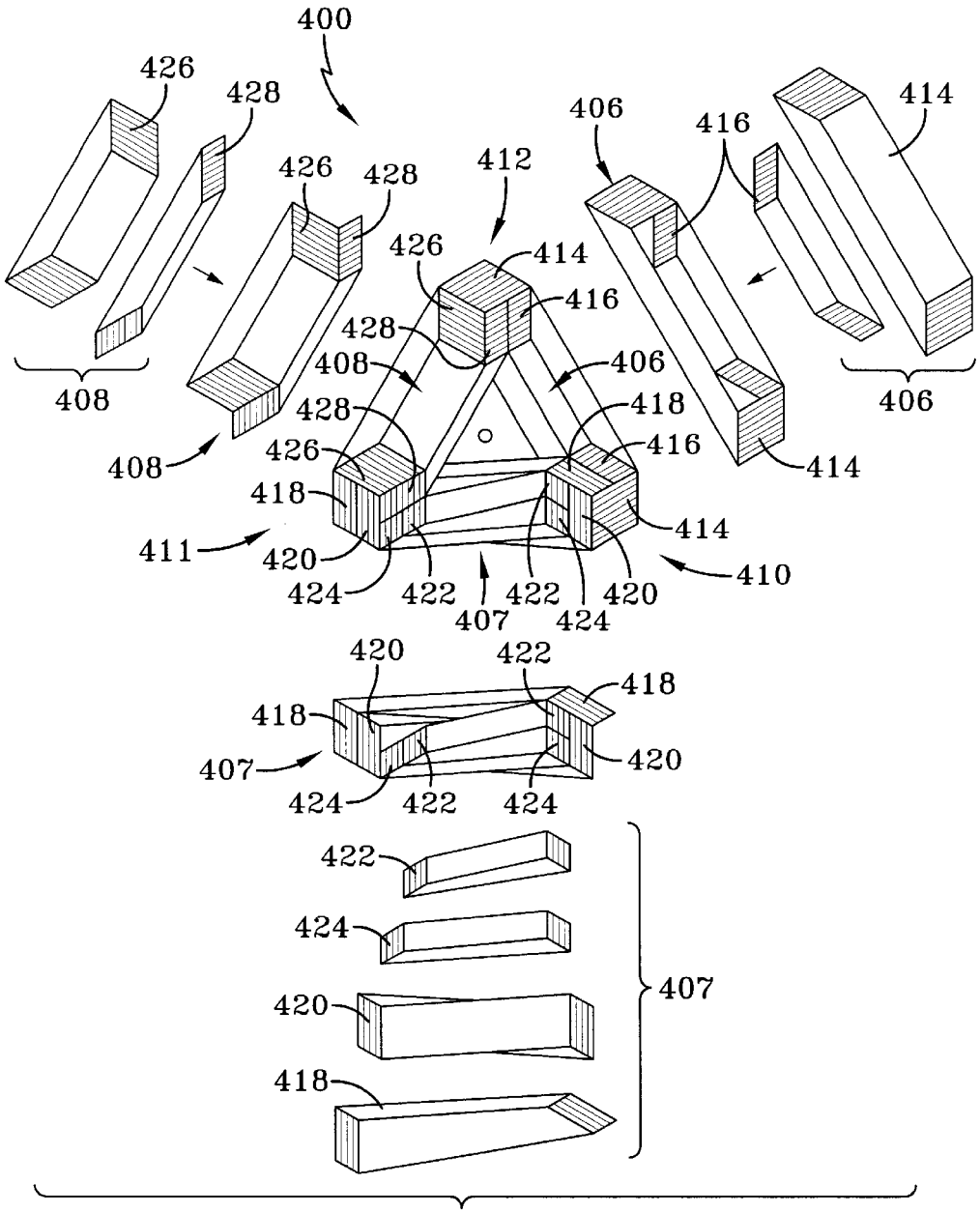
FIG. 22*a* is cross-sectional view of the core shown in FIG. 22, also including in exploded form the respective frames, and in a second exploded view showing each of the combined legs.
Figure 22:
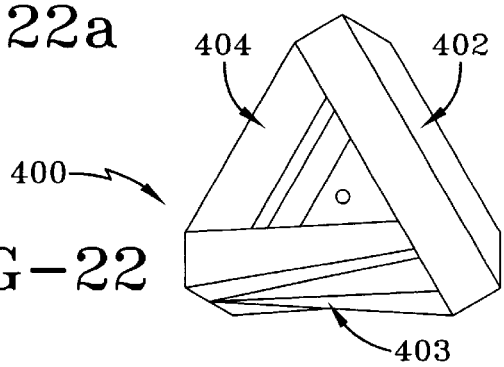
FIG. 22 is a plan view of another transformer core according to the invention.

Another three-phase transformer core is shown in FIG. 22, and identified by the numeral 400. Transformer core 400 is shown as a top view in FIG. 22 having yokes 402, 403, and 404. A cross-section of core 400 is shown in FIG. 22*a*, which also shows the core, and the frames, in exploded form. Core 400 has three frames 406, 407 and 408. It can be seen that frames 406–408 are different from each other, but this may be better for large transformers for reducing the strain on the core. Frames 406–408 together form legs 409, 410 and 411. Considering the view shown in the center portion of FIG. 22*a* and the exploded portion showing frame 406, it can be seen that the latter includes a basic broad, thick ring 414, and a narrow thick ring 416. Frame 407 is composed of a narrow thick ring 418, another narrow thick ring 420, a narrow thin ring 422 and another narrow thin ring 424.

Finally, considering frame 408, it can be seen that this leg includes a broad, thick ring 426 and a narrow, thick ring 428.

Transformer core 400 is composed of a set of rings, all of which are made from transformer plate of one width for each ring, combined in such a manner as to provide the desired legs with a hexagon cross-section in each leg. The construction of core 400 is different from other cores described earlier having hexagon cross-sections, but they all can be made using conventional manufacturing techniques with transformer plate of one width, namely broad or narrow.

Another way to describe the embodiment shown in FIGS. 22 and 22*a* is by way of the geometry of the cross-section of legs 409–411 of transformer core 400. Accordingly, the cross-section of leg 409 shows that it is composed of rhombs 414 and 426, and rhomboids 416 and 428. Leg 410 is composed of rhombs 414, rhomboids 416, 418 and 420, and has small rhombs 422, 424. Leg 411 has large rhomb 426, rhomboids 418, 420 and 428, and small rhombs 422, 424. Each leg 409–411 has legs of regular hexagons, since the width and thickness of rhombs 414 are of equal length; the width of rhomboids 416, 418, 420 and 428 are one half the width of rhombs 414 and 426; the thickness of the latter rhomboids is equal to that of rhombs 414 and 426; and the width of small rhombs 422 and 424 are one quarter the corresponding dimensions of large rhombs 414 and 426.

Figure 23:
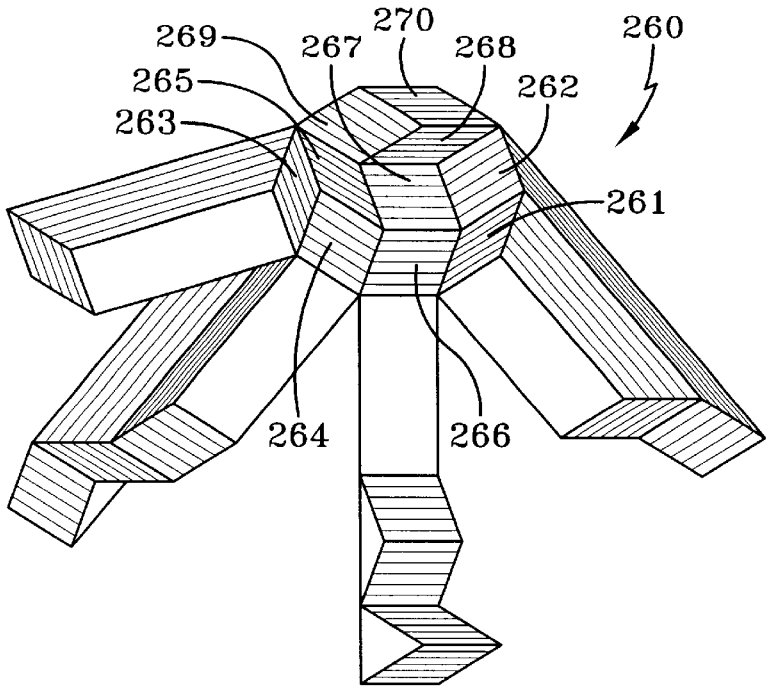
FIG. 23 is a single-phase transformer core with ten sides in cross-section according to the invention.

One would not expect that the provision of more rings in a transformer core could give simpler and better solutions to the problems noted earlier. A three-phase core with its legs in a row is relatively easy to assemble with octagonal legs, so one would not strive to make hexagonal legs. Single-frame cores can advantageously be made with decagonal legs. There are many decagons with inscribed rhombs. One of the decagons has the advantage that all but one of the rings for filling the rhombs have their axes in the three directions deviating with a minimum angle of 36°. A shell core 260 is shown in FIG. 23. It has rings providing in the cross section of shell core 260 rhombs 261–270.

Figure 24:
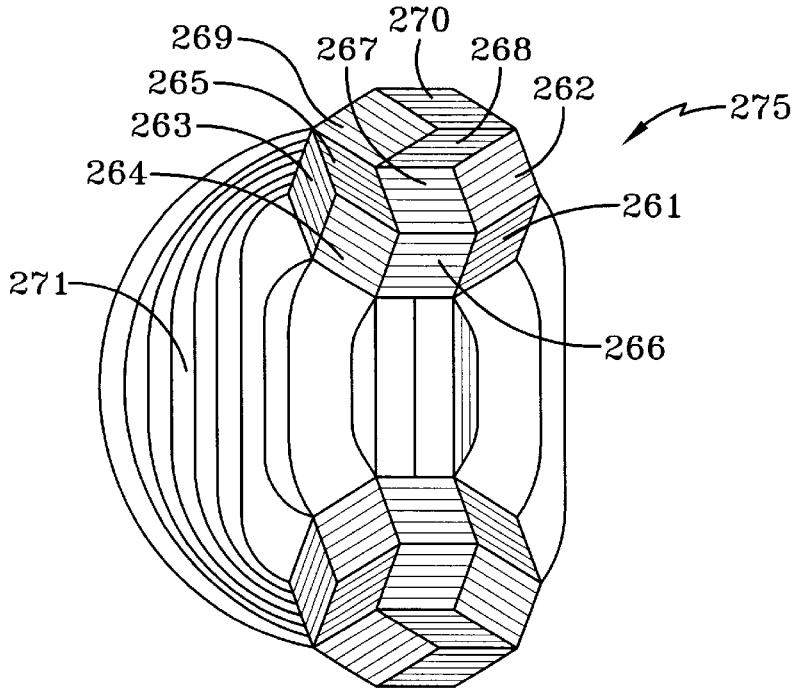
FIG. 24 is a single-phase transformer core with ten sides in cross-section according to the invention constructed for improved cooling.

By bending the yokes of core 260 shown in FIG. 23, a frame core 275 is obtained and shown in FIG. 24. Rings can be wound with the distance between the turns so that air can pass through it. The rhombs within the leg innermost is a rhomb with an angle of 72°. The rhombs are in layers with the number of rhombs from innermost 4,3,2,1. They are marked from left to right 263, 264, 266, 261. In second row they are 265, 267, 262. In third row they are 269 and 268. Last is a rhomb marked 270. In the first layer, the rhombs have all sides with the angle 72°. In the second layer, the rhombs have all sides with the angle 108°. In the third layer the rhombs have all sides with the angle 36°. In the fourth layer the rhomb has all sides with the angle 144°. This shows the systematic shape of this decagon with inscribed rhombs. The circle is so effectively filled that ring 263 could be omitted. A ring 271 having strongly turned out legs is especially good with respect to cooling because the yokes are also turned, so that air can rise when it passes between the strips. The foregoing tells us how to find the best shape of dodecagon etc. with inscribed rhombs. First the corresponding shell core was shown in FIG. 23. The rings need not have their frames or leg parts turned or yoke parts bent and were shown in FIG. 24. The surface of the strips with the air will be very large.

Some of the advantages of the inventive transformer core have already been mentioned. Among the other advantages the following can be mentioned: lower no load losses, less weight, less volume, lower electrical leakage, a reduction of the harmonics due to the symmetry of the phases of the three-phase transformer, easy maintenance etc. The mechanical stability of all of the cores can be improved by modifications to the cores to provide places for rings with octagonal legs as well as hexagonal, decagonal and other legs. The inventive core is insensitive to rough handling, as would occur during transport. It embodiment with interlocking frames are self-supporting. The weight saving over corresponding cores is very significant, amounting to about 40%; this is significant for large transformers whose weight is several tons. Transportation is facilitated in that the frames can be transported independently of each other.

Figure 25:
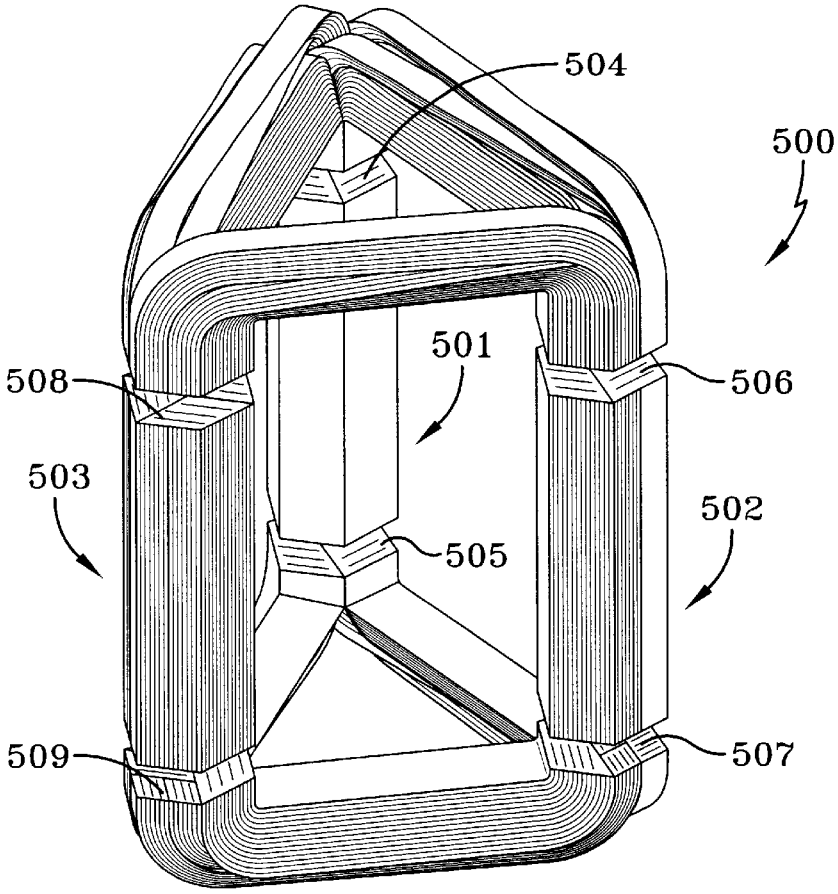
FIG. 25 is a inductor core according to another embodiment of the invention, shown in isometric form.

Referring next to FIG. 25, an inductor according to the invention is shown. It can be seen that this inductor has a construction very similar to the transformer core 20 shown in FIG. 2. However, the inductor, identified by the numeral 500, has a pair of air gaps extending through each leg. Thus, inductor 500 includes three legs 501, 502 and 503, each having as a cross-section a hexagon as that shown in transformer core 20 in FIG. 2. Each leg has a pair of air gaps identified as 504, 505 for leg 501, air spaces 506 and 507 for leg 502, and air gaps 508 and 509 for leg 503.

Figure 26:
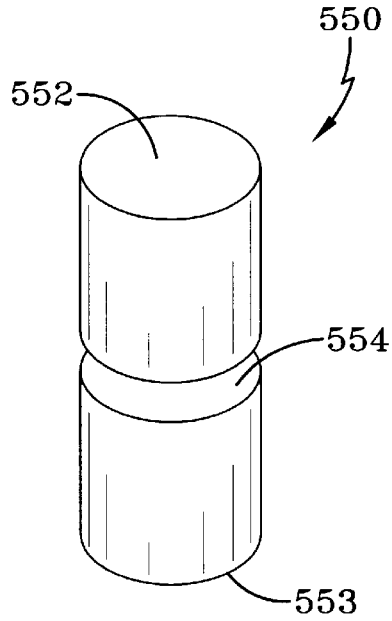
FIG. 26 is an alternative leg for the inductor shown in FIG. 25.

The hexagonal legs 501–503 could be replaced with cylindrical legs 550 shown in FIG. 26. Each leg 550 is divided into two parts having an air space 554 between them. Air spaces 552, 553 separate the opposite ends of leg 550 from the yokes of inductor 500.

Figure 27:
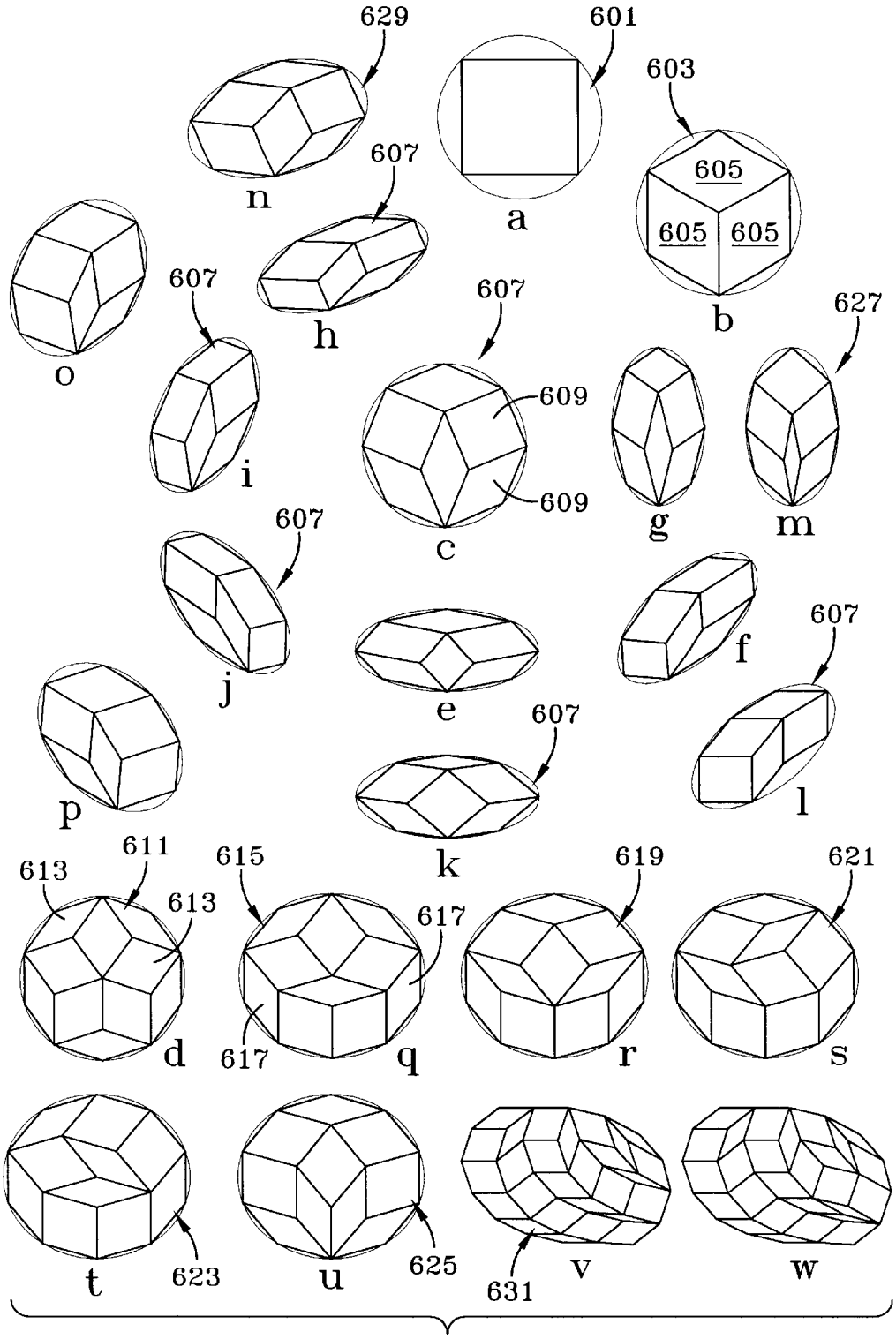
FIGS. 27*a*–27*w* are cross-sectional views of various transformer or inductor legs according to the invention.

The concept of the present invention can be used to provide legs of various cross sections, such as to fit into conductor coils having round or elliptical shapes, where the cross section approaches such shapes. These are shown in FIGS. 27*a*–27*w*. FIG. 27*a* is a quadrate 601. FIG. 27*b* depicts a hexagon 603 with three rhombs 605. FIG. 27*c* shows an octagon 607 with six rhombs 609. FIG. 27*d* illustrates a decagon 611 called a penrose having ten rhombs 613. Another possibility is shown in FIG. 27*q*, where there is a decagon 615 with ten rhombs 617, having no new rhombs created but are rather redistributed. FIGS. 27*r* through 27*u* are other examples of decagons 619, 621, 623 and 625, respectively. FIGS. 27*h* and 27*i* show the octagon 607 from two different corners. FIGS. 27*j* and 27*k* show octagon 607 from different sides. FIG. 271 depicts octagon 607 from a different direction. FIGS. 27*m* through 27*n* show that it is possible to alter rhomboids to rhombs in hexagons 627 and 629.

FIG. 27*v* illustrates that it is possible to inscribe rhombs in an ellipse, in a polygon 631. A contour which can be divided into two curves, one with a 180° rotation with respect to the other curve, can have rhombs inscribed within it. Polygons with less number of sides will appear inside the original polygon. They can be mirrored or rotated 180° and make it possible to redistribute the rhombs. A rotated hexagon is marked with a circle in FIG. 27*w*. Of course, matched irregular contours can circumscribe any form of collection of rhombs.

Figure 28:
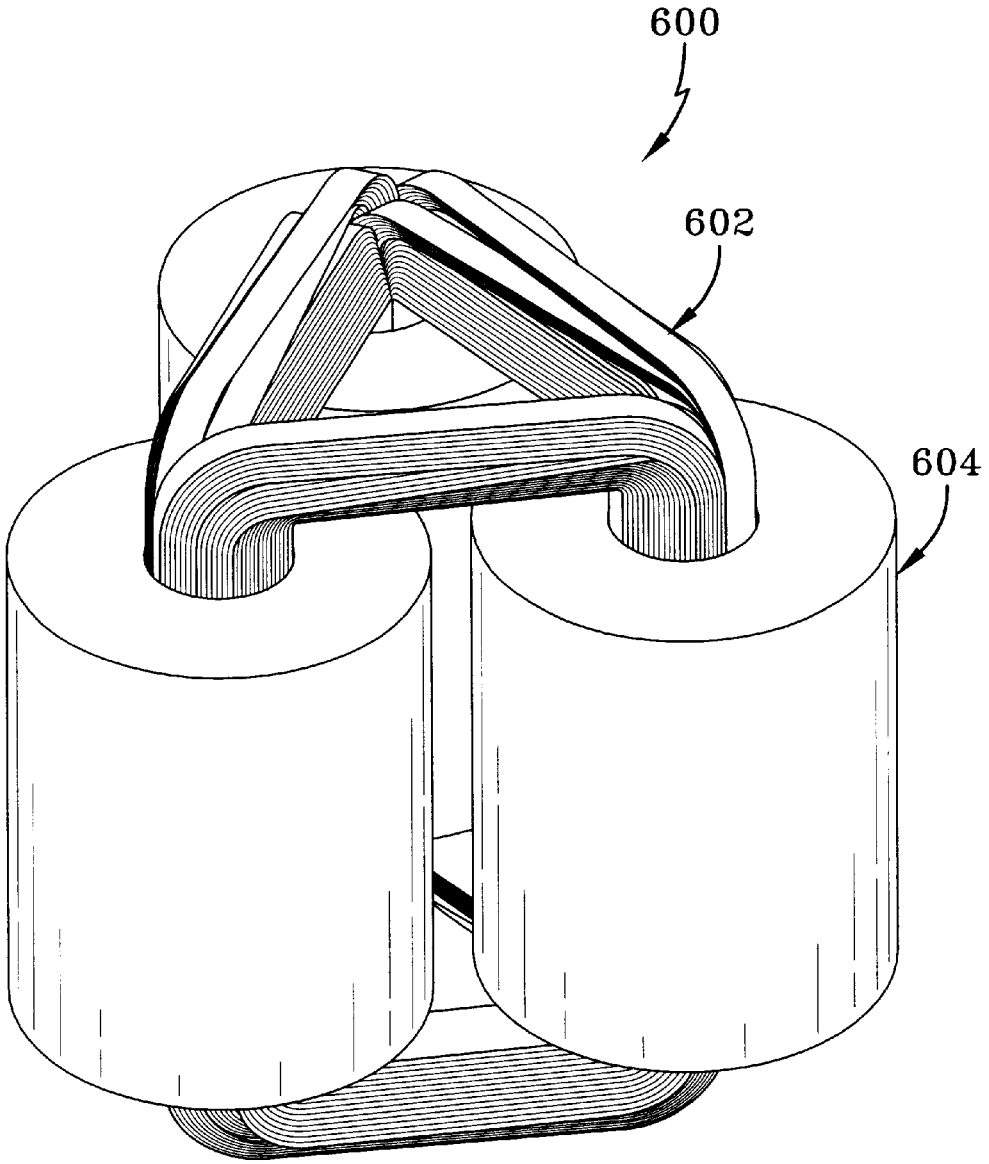
FIG. 28 is a schematic view of a transformer according to the invention.

A three-phase transformer 600 according to the invention is shown in FIG. 28. It includes a three-phase transformer core 602 as discussed earlier. Transformer 600 includes the primary windings and secondary windings as identified as winding assembly 604. Transformer 600 operates in the conventional manner, but having improved operating capabilities due to the core.

Figure 29:
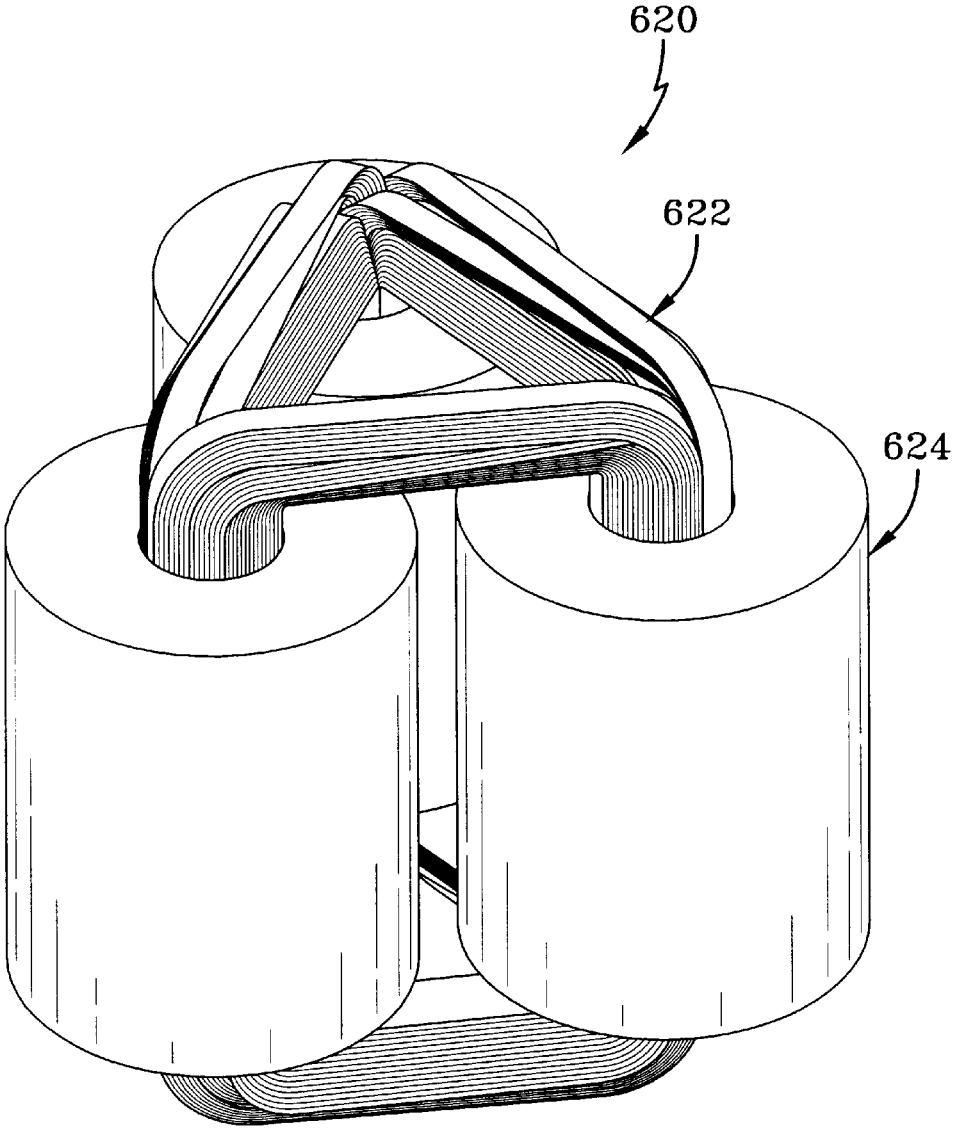
FIG. 29 is a schematic view of an inductor according to the invention.

FIG. 29 shows an inductor 620 according to the invention. It includes an inductor core 622 and a winding 624. The core was described earlier. The inductor operates in the ordinary fashion, having an improved output resulting from the core.

The invention has been described in detail, with particular detail with respect to the preferred embodiment. However, variations and modifications within the spirit and scope of the invention may occur to those skilled in the art to which the invention pertains.

What is claimed is:

1. A transformer core comprising three legs and yoke parts connecting said legs, wherein the cross-section of said legs is regularly multi-sided with more than four sides, said core comprising rings, each of said rings being rolled from a strip of constant width, wherein each of said rings makes up part of two of said legs and the yoke parts interconnecting said two legs, wherein each of said legs consists of parts of said rings, and all the adjacent sides of the cross-section of each of the legs meet at obtuse internal angles.

2. A transformer core according to claim 1, wherein said legs each have a hexagonal cross-section.

3. A transformer core according to claim 2, wherein said core comprises seven rings.

4. A transformer core according to claim 3, comprising:

a first, a second and a third ring wound from strips of a first width to a first thickness, the cross-sections of said rings being rhombic with two angles of 60 degrees, said first, second and third rings forming yoke parts together forming a triangle, a fourth ring wound from a strip of said first width to a second thickness essentially corresponding to half the first thickness, said fourth ring having rhomboidal cross-section and being positioned on said third ring, a fifth ring wound from a strip of a second width essentially corresponding to half the first width, to said first thickness, said fifth ring having rhomboidal cross-section and being positioned on said first ring, a sixth ring wound from a strip of the second width to said second thickness, said sixth ring having rhombic cross-section and being positioned on said second ring, and a seventh ring wound from a strip of the second width to said second thickness, said seventh ring having rhombic cross-section and being positioned on said second ring and on said sixth ring, whereby a three-phase transformer core with three legs with hexagonal cross-sections is formed.

5. A transformer core according to claim 1, wherein all of said rings have a rhombic cross-section with two angles of 60 degrees and two angles of 120 degrees.

6. A three-phase transformer core having three transformer legs, said core comprising a set of three frames, each frame having at least two rings, each one of the at least two rings in the respective frames being adjacent to another ring in the frame; and each of said rings being composed of a laminate of offset layers making each of said rings a profiled ring, the layers of each of said rings having a constant width and a thickness, the respective rings of each frame having constant widths and wound to a certain thickness, the dimensions of at least one of the widths and/or one of the thicknesses in at least one ring of a particular frame differing from the like dimensions of at least one of the rings forming said frame, each frame having two leg portions, the leg portion of each frame joining with the leg portion of another frame to form one of said three transformer legs, the cross-section of each of said three transformer legs having a polygon having at least six sides and all the adjacent sides meeting at obtuse internal angles.

7. A transformer core according to claim 6 wherein the width of each of said rings is either w or w/2.

8. A transformer core according to claim 6 wherein the thickness of each of said rings is either t or t/2.

9. A frame for a transformer core, said frame comprising at least two rings, each of said rings comprising wound strips of material for conducting magnetic flux, said wound strips each having a constant width and being splayed, said frame having two leg portions, at least one leg portion joining with the leg portion of another frame to form a leg, the cross-section of each of said legs being composed of straight sides, wherein the leg portions of at least one of said rings of said frame is splayed in a direction opposite the direction the other ring or rings of said frame are splayed.

10. A frame according to claim 9 wherein the cross-section of each of said legs is a polygon.

11. A frame according to claim 10 wherein the polygon is a regular polygon.

12. A frame according to claim 9 wherein the width of one of said rings is one half the width of another of said rings.

13. A frame according to claim 9 wherein the thickness of one of said rings is one half the thickness of another of said rings.

14. A frame according to claim 9 wherein the widths of all of the rings in said frame are elected from one value or a second value one half of said one value.

15. A frame according to claim 9 wherein the thicknesses of all of the rings in said frame are selected from one value or a second value one half of said one value.

16. A frame according to claim 9 wherein at least one of said rings is splayed in a direction opposite the direction the other rings of said frame arc splayed.

17. A frame according to claim 9 wherein said rings of said frame are in tight, non-separable contact with each other.

18. A frame according to claim 9 wherein said rings are of a generally rectangular configuration of different sizes, at least one of said rings being fit one inside the other.

19. A frame according to claim 18 wherein at least one of said rings extends at least partly through another ring larger than said one ring.

20. A frame according to claim 18 wherein the straight sides of each of said rings are generally in the same plane, and each of said rings has a central axis perpendicular to said sides and to said plane, at least one of said rings of said frame being tilted with respect to at least another of said rings, and at least one of said central axes making an angle with the central axis of the ring with which it is tilted.

21. A three-phase transformer core comprising a first leg, a second leg and a third leg, each leg being composed of two lanes, each frame being composed of at least two rings rolled from strips of constant width for conducting magnetic flux, each of said frames having two leg portions and two yoke portions, each of said legs having a cross-sectional shape that is multi-sided and having more than four sides and all the adjacent sides meeting at obtuse internal angles.

22. A three-phase transformer core according to claim 21 wherein the cross-section of each leg is a hexagon.

23. A transformer core according to claim 21 wherein said three frames form a triangle.

24. A three-phase transformer core comprising three legs, each leg being composed of a set of frames, each frame being composed of at least two rings rolled from strips of material for conducting magnetic flux, the width of the strip of each ring being of constant width and being splayed, each frame having two leg portions for cooperating with the leg portion of another frame to form a leg, each of said legs being multi-sided and having more than four sides, said frames being generally co-planar and all the adjacent sides or the cross-section of each of said legs meeting at obtuse internal angles.

25. A transformer core comprising at least two legs and yoke parts interconnecting said legs;

said core comprising rings, each of said rings being rolled from a strip of magnetic material of constant width;

portions of each of said rings forming part of two of said legs and the yokes interconnecting said two legs;

said two legs consisting of rings forming part of two said legs;

the cross-section of said legs being multi-sided and having more than four sides;

all the adjacent sides meeting at obtuse internal angles.

26. A method of manufacturing a transformer core comprising at least two legs and yoke parts connecting the legs, said method comprising the following steps:

winding strips of magnetic material of constant width into rings; and assembling said rings into a core, wherein:

portions of each of said rings forms part of two of the legs and yokes interconnecting the two legs, with each leg consisting of portions of rings forming part of two of said legs;

the cross-section of the legs is multi-sided with more than four sides; and all the adjacent sides meet at obtuse internal angles.

27. A transformer core comprising at least two legs and yoke parts interconnecting said two legs;

said core comprising rings rolled from strips of magnetic material of constant width to a certain thickness;

portions of each of said rings forming part of two of said legs and yokes interconnecting said two legs, each of said legs consisting of portions of rings forming part of two of said legs;

the cross-sections of said legs being multi-sided with more than four sides; and all the adjacent sides meeting at internal angles of less than 180 degrees.

28. A method of manufacturing a transformer core comprising legs and yoke parts interconnecting the legs, said method comprising the following steps:

winding strips of magnetic material of constant width into rings; and assembling said rings into a core, wherein:

portions of each of the rings forms part of two of the legs and yokes interconnecting the two legs, each of said legs consisting of rings forming part of two of said legs;

the cross-section of the legs is multi-sided with more than four sides; and all the adjacent sides meet at internal angles of less than 180 degrees.

* * * * *

UNITED STATES PATENT AND TRADEMARK OFFICE

CERTIFICATE OF CORRECTION

PATENT NO. : 6,683,524 B1
DATED : January 27, 2004
INVENTOR(S) : Lennart Hoglund It is certified that error appears in the above-identified patent and that said Letters Patent is hereby corrected as shown below:

Title page,
Item [63], add reference to the prior, parent U.S. patent application as follows:

-- Related U.S. Application Data

[63] Continuation-in-part of application No. 09/146,501 filed on Sept. 2, 1998, now abandoned. --

Signed and Sealed this

Eighteenth Day of May, 2004

JON W. DUDAS
*Acting Director of the United States Patent and Trademark Office*